US009254705B2

(12) United States Patent
Melgaard

(10) Patent No.: US 9,254,705 B2
(45) Date of Patent: Feb. 9, 2016

(54) RING BINDER HAVING ATTACHABLE AND DETACHABLE COVERS

(75) Inventor: Brian Melgaard, Boonton, NJ (US)

(73) Assignee: DELI GROUP CO, LTD. (CN)

( * ) Notice: Subject to any disclaimer, the term of this patent is extended or adjusted under 35 U.S.C. 154(b) by 967 days.

(21) Appl. No.: 13/404,234

(22) Filed: Feb. 24, 2012

(65) Prior Publication Data

US 2013/0223917 A1 Aug. 29, 2013

(51) Int. Cl.
*B42F 13/00* (2006.01)
*B42F 13/38* (2006.01)

(52) U.S. Cl.
CPC ..... *B42F 13/0006* (2013.01); *B42F 13/002* (2013.01); *B42F 13/38* (2013.01)

(58) Field of Classification Search
CPC .. B42F 13/0006; B42F 13/002; B42F 13/004; B42F 13/38
USPC ..... 402/77
See application file for complete search history.

(56) References Cited

U.S. PATENT DOCUMENTS

| | | | | |
|---|---|---|---|---|
| 2,099,472 | A | 11/1937 | Emery | |
| 3,074,744 | A * | 1/1963 | Pucci et al. | 281/37 |
| 5,158,387 | A * | 10/1992 | Davies | 402/76 |
| 6,179,508 | B1 | 1/2001 | Coerver | |
| 6,379,070 | B1 * | 4/2002 | Butchma | 402/73 |
| 2009/0127842 | A1 | 5/2009 | Minnick et al. | |

FOREIGN PATENT DOCUMENTS

| | | |
|---|---|---|
| CH | 687072 A5 | 9/1996 |
| WO | 00/16989 | 3/2000 |

OTHER PUBLICATIONS

International Preliminary Report on Patentability and Written Opinion mailed Sep. 4, 2014 issued in connection with corresponding International Application No. PCT/US13126524 (8 pages total).

Canadian Office Action mailed Oct. 30, 2015 issued in connection with corresponding Canadian Application No. 2,863,611 (6 pages total).

* cited by examiner

*Primary Examiner* — Matthew G Katcoff
(74) *Attorney, Agent, or Firm* — Mark K. Young; Mayer & Williams PC

(57) ABSTRACT

A ring binder is provided that has attachable and detachable covers. The opposite edges of the binder's spine are hingedly attached to the proximal edges of respective front and back extensions which are relatively short in a direction perpendicular to the hinge axes. The extensions are sized to be substantially coextensive with the maximum projection of the binder's rings along an axis that is perpendicular to the inside surface of the spine, and the rings and associated structures are either mounted on the inside of the spine or inside of the back extension depending on the ring type. The front and back extensions function to extend the front and back covers to the hinges when the covers are attached to the extensions' distal edges. When so attached, an assembled ring binder having hinged covers is created that appears and functions as a conventional binder when used.

12 Claims, 30 Drawing Sheets

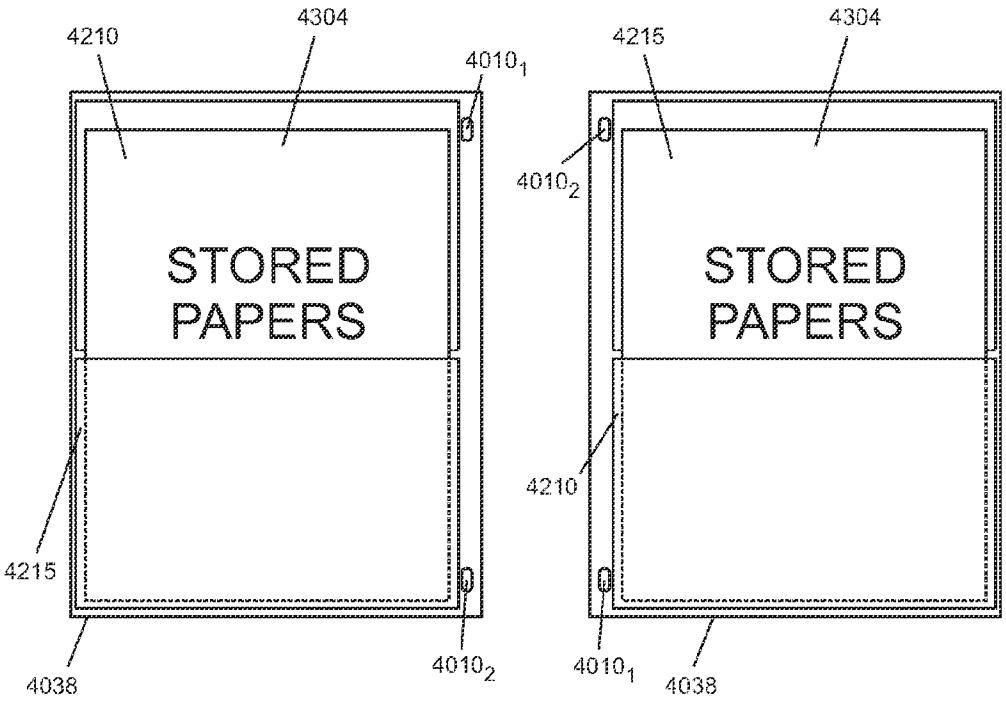
FIG. 45
FIG. 44
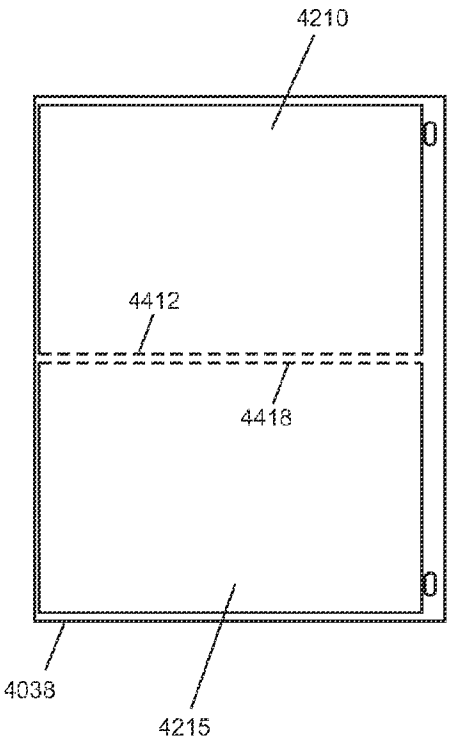

RING BINDER HAVING ATTACHABLE AND DETACHABLE COVERS

BACKGROUND

Ring binders are commonly used in home, school, and business environments to store and present sheets of paper. Conventional ring binders may be manufactured, for example, using a single sheet of plastic that forms a spine with integral front and back covers, or by using vinyl-clad cardboard to form the spine and covers. A set of rings to hold the papers and a supporting structure, which may include a mechanism to open and close the rings, are typically attached to the spine or back cover to complete the binder. Ring binders are available in a variety of sizes and ring configurations to accommodate various sizes and quantities of paper.

Binder manufacturers and office supply retailers often dedicate a significant amount of display and warehouse space to conventional ring binders which, due to the nature of their design, are somewhat bulky. As a result of this bulk, when ring binders are packaged for shipping, the boxes that contain the binders cannot be densely packed and are typically half filled with air. The disadvantages associated with the inherent bulkiness of conventional ring binders persist at the point of retail display and sale. When the ring binders are placed on a retail shelf, they can often occupy a significant amount of space in order to adequately display the typical breadth of available binder sizes, colors, and other features. End-users can also experience issues with storing and handling bulky conventional ring binders prior to use.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

A ring binder is provided that has attachable and detachable covers. The opposite edges of the binder's spine are hingedly attached to the proximal edges of respective front and back extensions which are relatively short in a direction perpendicular to the hinge axes. The extensions are sized to be substantially coextensive with the maximum projection of the binder's rings along an axis that is perpendicular to the inside surface of the spine, and the rings and associated structures are either mounted on the inside of the spine or inside of the back extension depending on the ring type. The front and back extensions function to extend the front and back covers to the hinges when the covers are attached to the extensions' distal edges. When so attached, an assembled ring binder having hinged covers is created that appears and functions as a conventional binder when used.

Various alternative arrangements for attaching and detaching the covers to the extension may be utilized depending on the particular implementation requirements. Such arrangements illustratively include hook and loop, mating studs and receptacles, mating posts and slots, and a dovetail joint. One exemplary embodiment uses snap-fit fasteners disposed on the distal end of each extension that mateably engage with through holes that are positioned along the mating edge of each of the covers.

Advantageously, the present ring binder with attachable and detachable covers can typically be expected to help realize significant savings in packing, shipping, storing, and retail display costs because the binders can remain unassembled until after the end-user completes a binder purchase. The unassembled binders are much less bulky and will generally take less than half the volume used to store and display conventional binders. In addition, the covers can be configured to be fully interchangeable with the spine/extensions so that end-users have the flexibility to assemble different cover colors or cover types in a given binder, or replace a cover later. Such interchangeability may be expected to give end-users more choices when purchasing and using ring binders.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWINGS

FIGS. 42-47 show an illustrative cover having pockets used for storing papers and similar items;

Like reference numerals indicate like elements in the drawings. Unless otherwise indicated, the figures are not drawn to scale.

DETAILED DESCRIPTION

Figure 1:
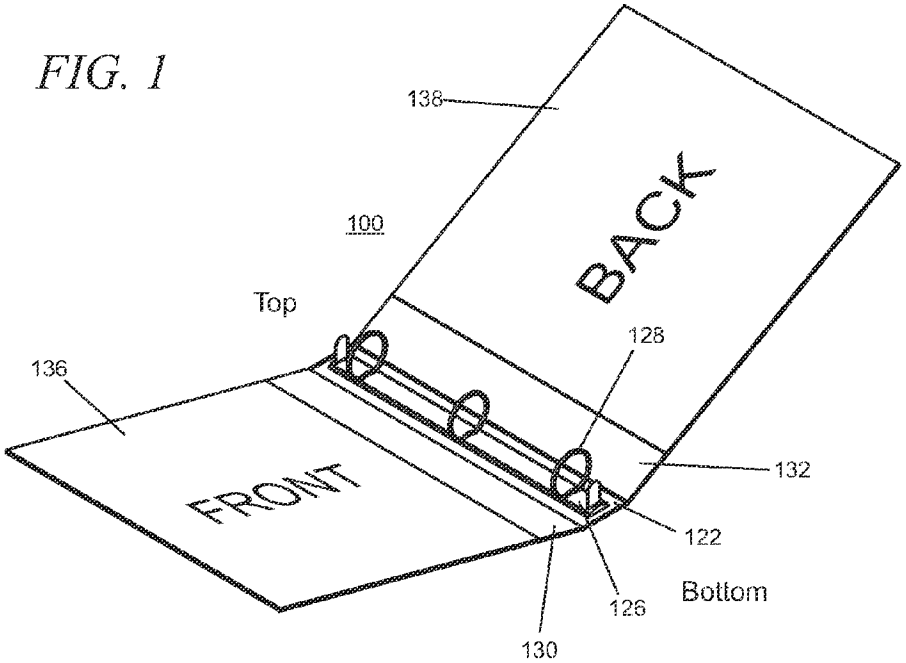
FIGS. 1 and 2 show an illustrative circular ring binder having attachable and detachable covers.

FIG. 1 shows an illustrative ring binder 100 having attachable and detachable covers. As shown, the ring binder 100 is configured with its covers attached so that the binder is ready for use in a customary manner. The ring binder 100 includes a spine 122 and a ring mechanism 126. The ring mechanism 126 may be conventionally configured and includes a set of three substantially circular rings, representatively indicated by reference numeral 128 that may be opened and closed to insert and remove loose leaf paper. However, the number of rings utilized and the particular type and configuration of the opening and closing mechanism, including its principles of operation and materials used in its construction, can vary by implementation.

Different ring sizes are utilized for different binder page storage capacities. Thus, in the United States for example, where inches are commonly used for measurement, conventional binders come in different sizes such as "half-inch," "one-inch," "two-inch," "three-inch," "four-inch," etc. which refers to the nominal spine size or ring diameter. Ring binders are typically sized to hold 8.5×11 inch papers having three holes. However, other paper sizes (legal, A4, etc.), binder sizes, and ring configurations may also be accommodated by the present ring binder designs.

FIG. 1 shows extensions that are hingedly attached to the spine 122 at their proximal edges as indicated by reference numerals 130 and 132. Covers 136 and 138 are removably and fixedly attached to respective extensions 130 and 132, as shown, along the distal edges of the extensions. In an alternative arrangement (not shown in the drawings), the extensions may be fixedly attached to the spine at their proximal edges and a single hinge that is typically disposed in the center of the spine is utilized to enable the covers to rotatably open and close about the central hinge.

It is noted at this point in the discussion that the terms "front" and "back" may be used to denote a particular portion of the ring binder 100. Accordingly, as shown in FIG. 1, cover 136 may be referred to as the "front cover" and cover 138 may be referred to as the "back cover." Similarly, extension 130 may be referred to as the "front extension" and extension 132 may be referred to as the "back extension." Similarly, the terms "top" and "bottom" are used on occasion to refer to portions of the binder. And, in a similar manner when conventionally referring to a book, portions of the present ring binder may be referred to using terms such as "inside front cover," "outside back cover," and the like. However, it is emphasized that this terminology is utilized simply for sake of clarity and convenience in the description of the present ring binder that follows because the binder is typically symmetrical about the centrally disposed spine 122 and the designation of front and back, and top and bottom, is arbitrary. In addition, the covers 136 and 138 are identically configured, in typical applications, and may be used interchangeably as either a front or back cover, as described in more detail below.

Figure 2:
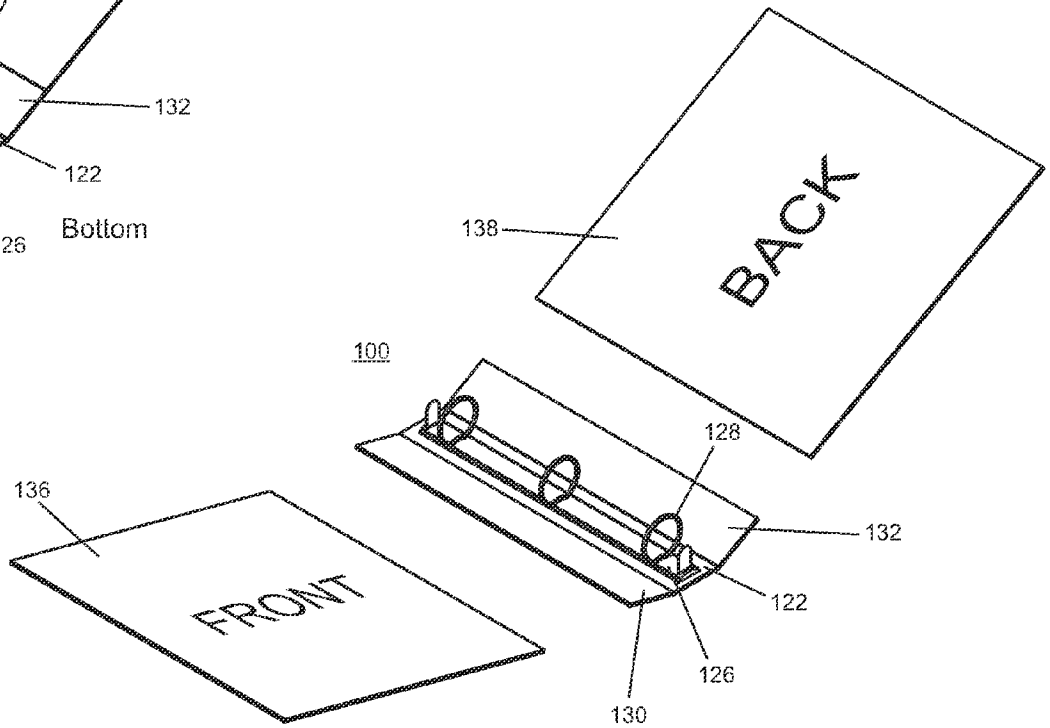

FIG. 2 shows the ring binder 100 with its covers 136 and 138 detached from the respective extensions 130 and 132. In many typical applications, the ring binder 100 can be configured so that the covers may be repeatedly attached and detached from the extensions. For example, covers, spine, and extensions may be sold in various colors and a ring binder user may wish to change the binder's color by attaching a new cover. Alternatively, in some implementations of the present ring binder, the binder may be configured so that the covers are readily attached by an end user or retailer, but are not intended to be detached once attached. For example, some end users may prefer using the present ring binder in a completely conventional way and have little desire to change binder components after the binder is initially assembled. But even in such cases, the present arrangement may still enable shipping and storage costs to be reduced as the disassembled ring binders are significantly less bulky than conventional binders. Details of the attachment between the covers and extensions are omitted from the views of the ring binder shown in FIGS. 1-10 for sake of clarity of exposition. Various types of attaching arrangements and/or mechanisms which may be utilized by the present ring binder are shown in detail in FIGS. 11-39 and described in the accompanying text.

Figure 4:
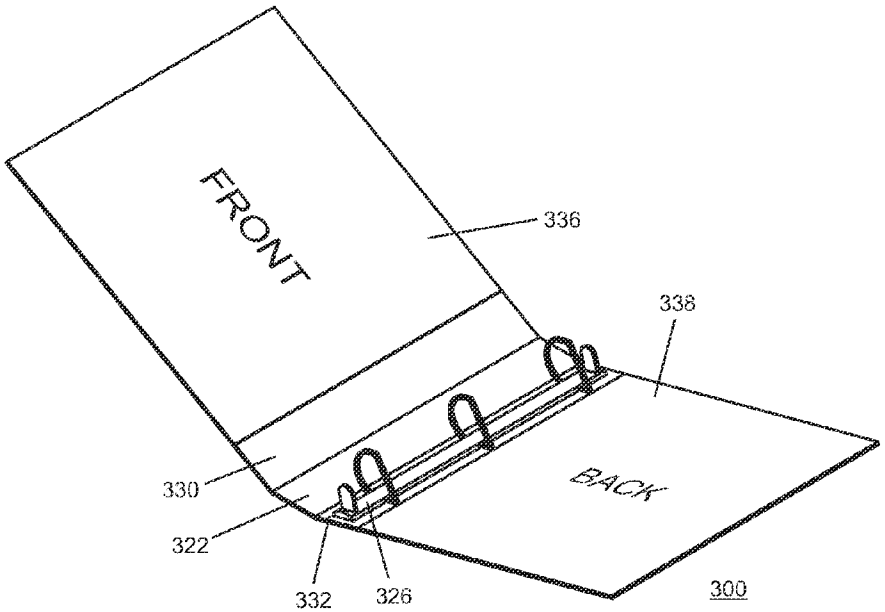
FIGS. 3 and 4 show an illustrative D ring binder having attachable and detachable covers.
Figure 3:
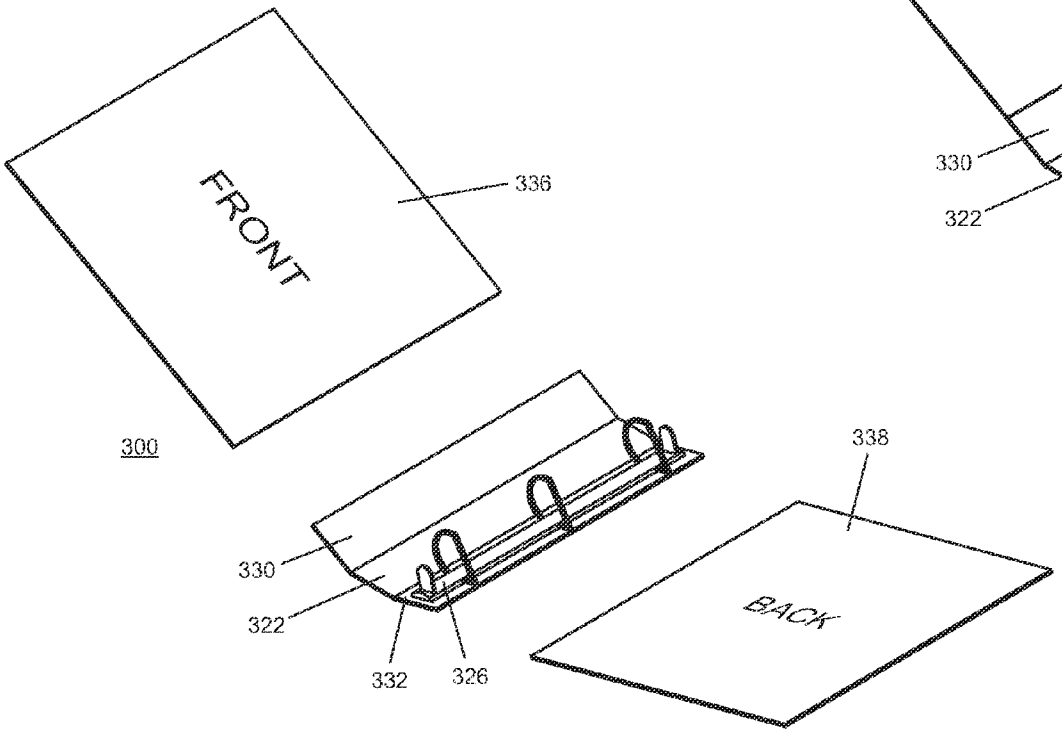

FIG. 3 shows another illustrative ring binder 300 where its detachable covers 336 and 338 are shown detached from the respective extensions 330 and 332. FIG. 4 shows the ring binder 300 with its covers in the attached configuration. Ring binder 300 uses what is commonly known as a "D" ring mechanism 326 which may be utilized as an alternative to the circular rings shown in FIGS. 1 and 2. Binders using "D" rings may be desirable in some applications, particularly those where relatively large amounts of paper need to be held in the binder. As with the ring binder 100 discussed above, the number of rings shown in FIGS. 3 and 4 is three, but various other numbers of rings and types of ring opening and closing arrangements may be utilized to meet the needs of a particular implementation.

The D ring mechanism 326 in ring binder 300 is located on the back extension 332 and not on the central spine 322, in comparison to the circular ring mechanism shown in FIGS. 1 and 2. Accordingly, the ring binder 300 is not symmetrical about the long axis of the spine 322 unlike the binder 100. The ring binder 300 will be typically oriented as shown when opened to enable the bound pages to lie flat against the back cover 338. As pages are turned to expose their backs, they are guided along the D ring and positioned on the curved portion of the ring so that the fronts of the pages face the front cover 336.

D ring binders are typically sized for additional page storage capacity by configuring the D rings taller. That is, the height of the D ring increases disproportionately to its width as page capacity is increased to achieve a given binder size. In typical circular ring binders, by comparison, the ring size gets bigger proportionally in both height and width as the page capacity is increased for a given binder size (i.e., a circular ring stays circular with increasing page capacity, while a D ring becomes elongated with increasing page capacity). Therefore, to provide an array of circular ringer binders of different sizes, the binder's spine will generally be configured in increasingly wider widths to accommodate the larger ring diameter. As the spine width increases, the extension width will also increase in most typical implementations.

Figure 5:
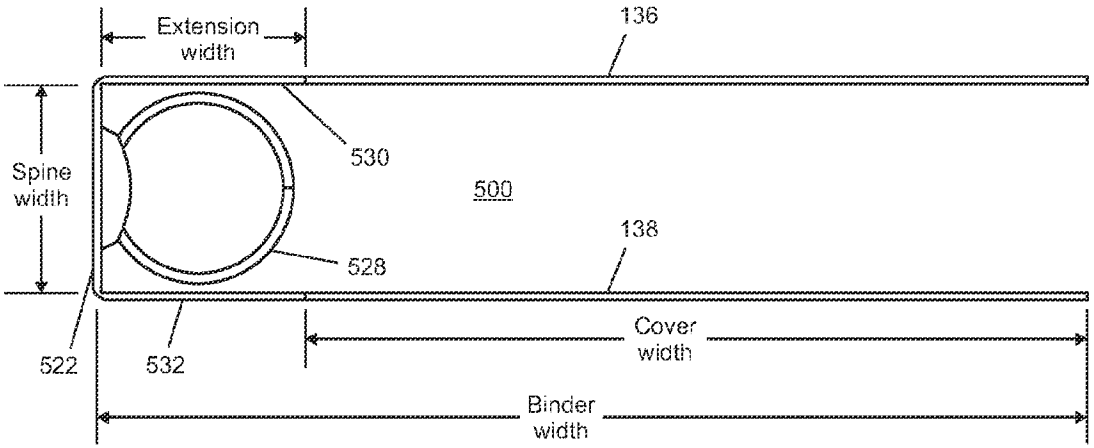
FIGS. 5 and 6 depict end views of two different sized circular ring binders.
Figure 6:
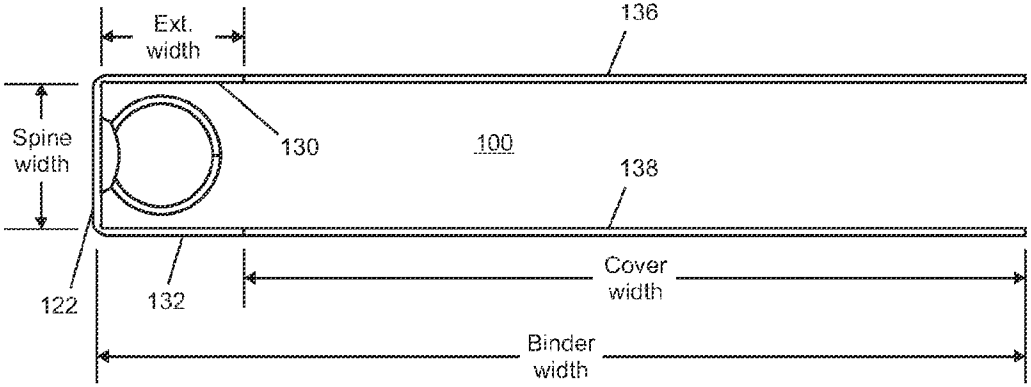

FIGS. 5 and 6 depict end views of two different sized circular ring binders in which spine and extension widths are increased in order to accommodate an increase in ring diameter (portions of the ring mechanism are omitted for clarity). Here, the spine 522 of the larger size ring binder 500 in FIG. 5 is wider than the spine 122 of the smaller size ring binder 100 in FIG. 6 (where it is noted that FIGS. 5 and 6 are scaled the same). The front extension 530 and back extension 532 of binder 500 also have increased width compared to the extensions 130 and 132 of binder 100 so that they project from the spine 522 to be substantially coextensive with maximum projection of the ring 528 from the spine. While the degree to which the extension width and ring are coextensive can vary by implementation, typically the extensions are approximately sized to fully cover the ring when the extensions are positioned near or touching the ring. Such coverage helps prevent the unassembled binders from getting tangled on their rings during handling and when being shipped, stored, and displayed, for example. In typical applications, the extensions can be variably configured as needed to meet the requirements of a particular implementation to extend up to approximately one inch beyond the maximum projection of the ring from the spine or be configured to be shorter than the maximum projection by approximately one-half inch while still providing the desired ring coverage. Extending the width beyond an inch or so past the maximum ring projection can make the assembled binder's overall width unacceptably large in some cases particularly when the attached cover incorporates a "view" feature as described in the text accompanying FIGS. 40 and 41 and thus needs to be wider than the 8.5 inches of a letter-sized sheet of paper.

Because the extensions are relatively wider in larger binder sizes, when the front cover 136 and back cover 138 are attached to the respective extensions 530 and 532, the larger binder 500 will have an overall width that is greater than that of smaller binder 100, as shown in the drawings. While use of a common cover width results in circular ring binders of different sizes having different overall widths, a common cover width is advantageous in typical applications to avoid having to provide and stock multiple different unique covers.

Figure 7:
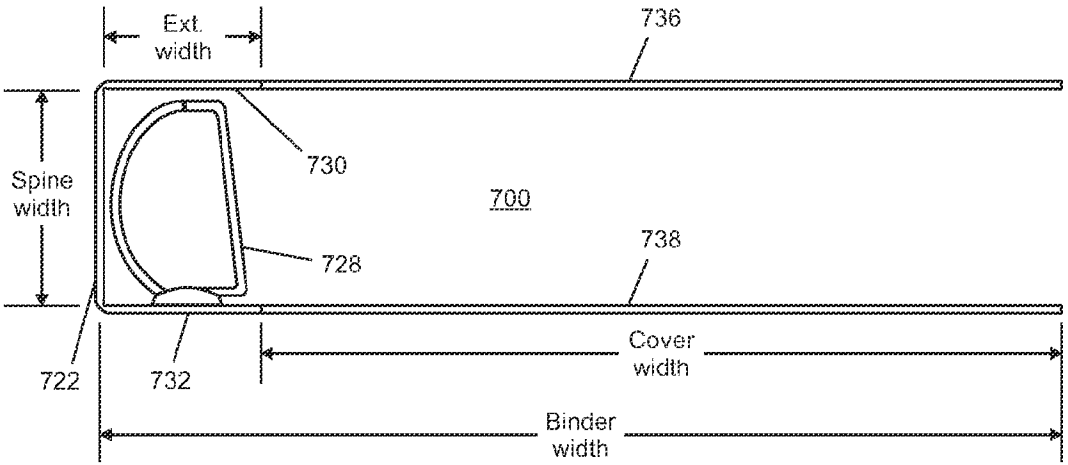
FIGS. 7 and 8 depict end views of two different sized D ring binders.
Figure 8:
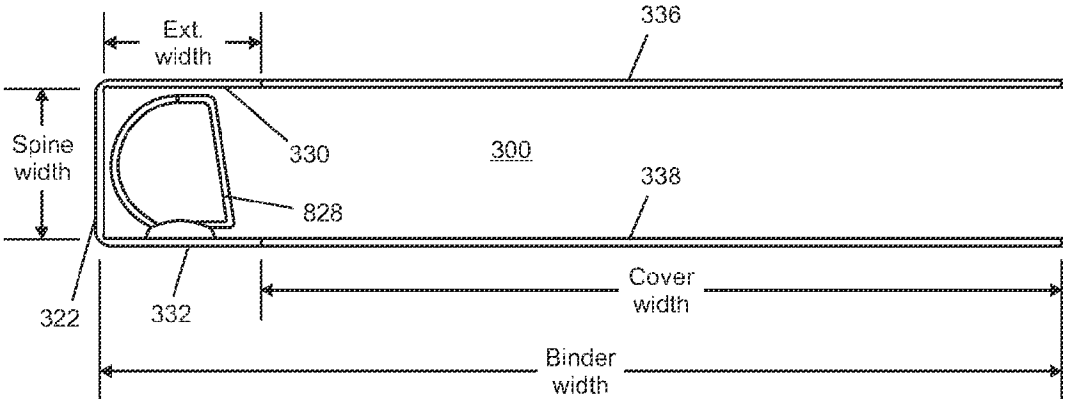

FIGS. 7 and 8 depict end views of two different sized D ring binders in which only the spine width is increased in order to accommodate a larger D ring 728 in FIG. 7. The D ring 728 has increased paper capacity compared to the smaller D ring 828 in FIG. 8 (it is noted that FIGS. 7 and 8 are scaled the same). As shown, the spine 722 of the larger size ring binder 700 in FIG. 7 is wider than the spine 322 of the smaller size ring binder 300 in FIG. 8. However, the front extension 730 and the back extension 732 of binder 700 do not typically need to increase in width as the D ring increases in size. As shown in FIGS. 7 and 8, extensions 730 and 732 in binder 700 have the same widths as the extensions 330 and 332 in the smaller binder 300. A commonly utilized extension width may help D ring binders of different sizes maintain a consistent appearance and enables the D ring binders of all sizes to share a common overall binder width. As with the ring binder having circular rings shown in FIGS. 5 and 6, the extension width can be varied according to the requirements of a particular implementation.

Figure 9:
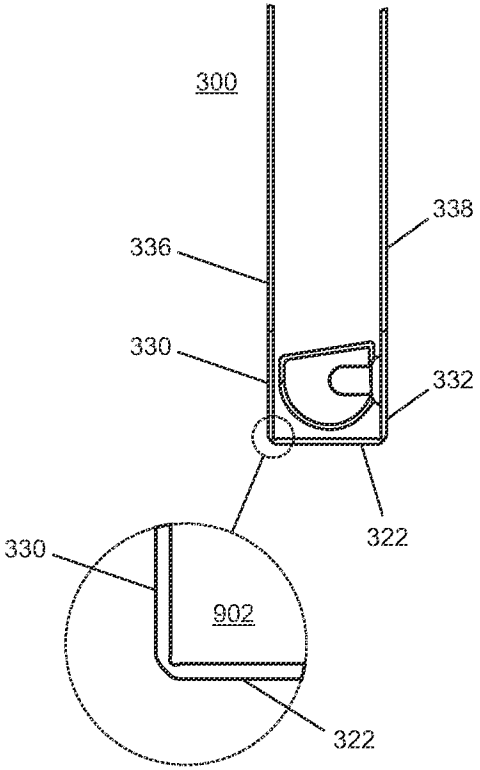
FIG. 9 shows an enlarged detail of an illustrative hinge between a spine and extension in a D ring binder.

FIG. 9 shows an enlarged detail of an illustrative hinge 902 between the spine and front extension in the D ring binder 300. While a D ring binder is shown, the hinge may be similar in circular ring binders as well. Various conventional hinge types may be utilized in the present ring binders depending on the requirements of a particular application and typically the same hinge type is used for both hinges between the extensions and spine. The hinge may be arranged from multiple components to enable rotation of the extension about the spine or, as in this illustrative example, be configured as a living hinge that is integrally formed with the spine 322 and the extensions 330 and 332 when these components are formed as a unitary object, for example using injection-molded plastics such as polypropylene or polyethylene.

The hinge 902 is configured to be formed with a reduced wall thickness as shown in FIG. 9. Typically, the mold is designed to enable the injected plastic to flow in a substantially perpendicular direction across the long axis of the hinge. Such flow pattern enables the long-chain polymer molecules to become aligned in the direction of flow so that the hinge, even though relatively thin walled, is very strong in the flow direction.

Figure 10:
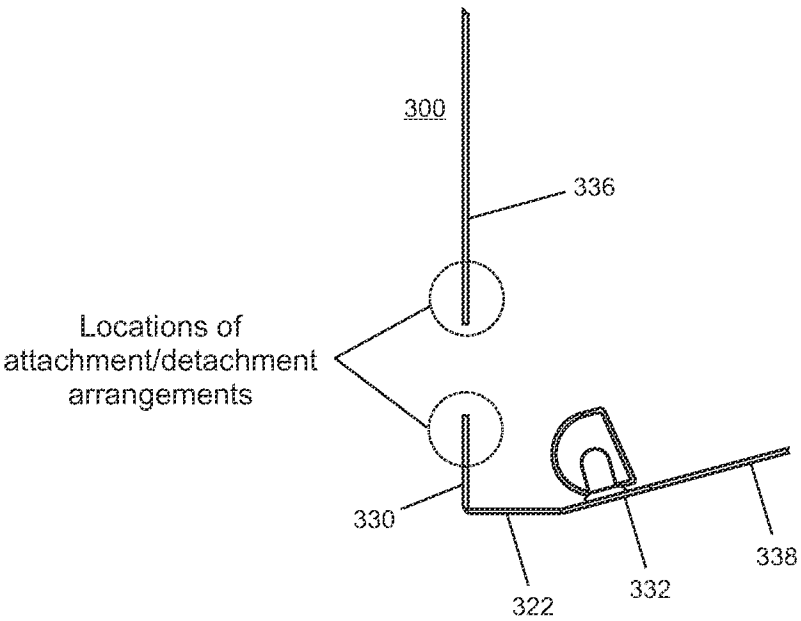
FIG. 10 shows the locations of attachment/detachment arrangements on opposing portions of a cover and extension.

Details of various exemplary arrangements for attaching and detaching the covers to the extensions are now presented. As shown in FIG. 10, such arrangements will typically be located on opposing portions of the cover and extension. The arrangements are applicable to both circular ring and D ring binders even though D ring binders are used in the examples. It is noted that the different attachment and detachment arrangements shown in FIGS. 11-39 and described in the accompanying text can also be utilized in various combinations in some ring binder implementations.

Figure 11:
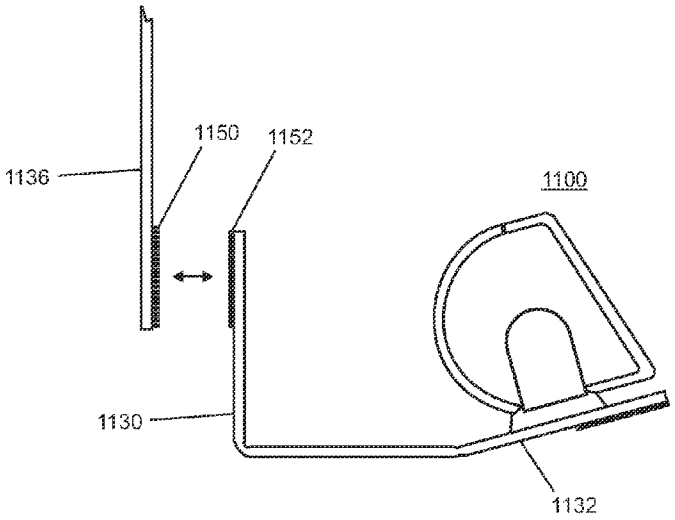
Figure 12:
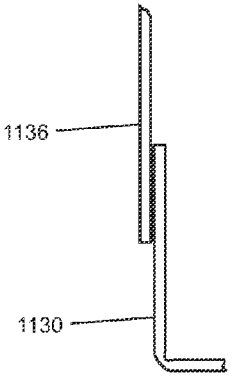

FIG. 11 shows an illustrative example in which hook and loop material is respectively disposed on portions of a cover 1136 and extensions 1130 and 1132 of a D ring binder 1100. While hook 1150 is shown on a portion of the cover 1136 and loop 1152 on the extension 1130, the materials could be reversed in some implementations (i.e., loop on the covers and hook on the extensions). The hook and loop may extend substantially along the entire length (i.e., long axis) of the respective covers and extensions, or be disposed along only portions of the covers and extensions. When the cover 1136 is attached to the extension 1130, the cover and extension will form an overlapping joint in the area of the hook and loop, as shown in FIG. 12.

Figure 13:
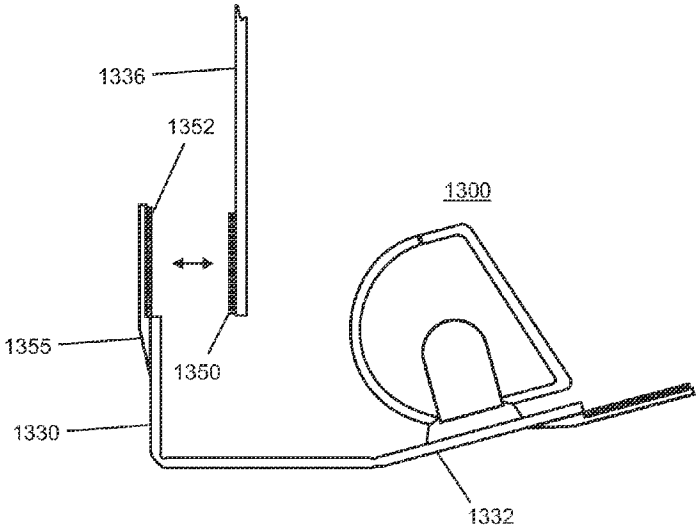
FIGS. 11-14 show illustrative examples of attachment/detachment arrangements in which hoop and loop material is respectively disposed on portions of a cover and extensions of a D ring binder 1100.
Figure 14:
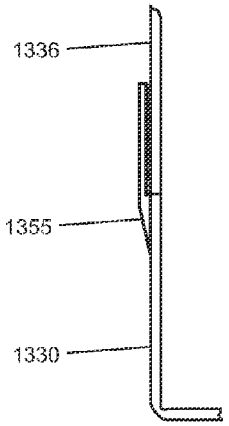

FIG. 13 shows an alternative attachment/detachment configuration using hook and loop material that enables a cover 1336 of a D ring binder 1300 to form a "butt joint" with the extension 1330. Hook material 1350 is disposed on a portion of the cover 1336 while an offset flange 1355 projecting from the extension 1330 supports the loop 1352, as shown. The flanges may extend substantially along the entire long axes of the extensions 1330 and 1332, or be disposed along only portions of the extensions. When the cover 1336 is attached to the offset flange 1355, the cover 1336 and extension 1330 will form a butt joint, as shown in FIG. 14.

Figure 15:
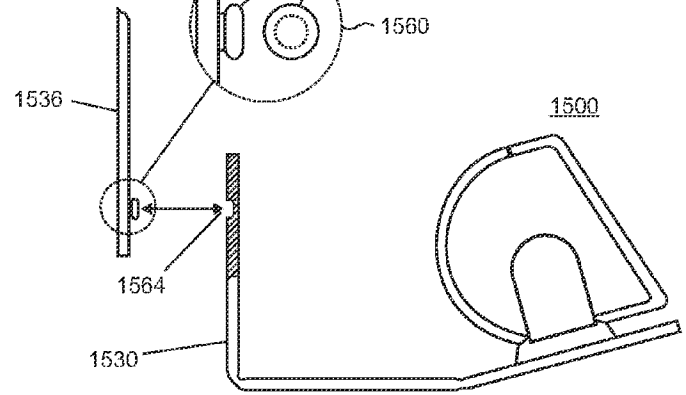
FIGS. 15 and 16 show an illustrative example of an attachment/detachment arrangement using a mating snap and receptacle.
Figure 16:
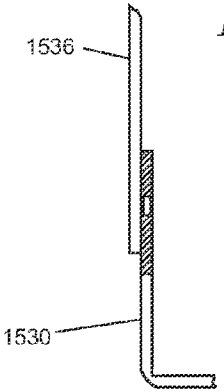

FIG. 15 shows an illustrative arrangement by which a cover 1536 of a D ring binder 1500 may be attached and detached from an extension 1530 using a mating stud and receptacle. A stud 1558 (shown in two enlarged detail views as indicated by reference numeral 1560) has a narrow portion proximal to the cover 1536 and a wide portion at the stud's distal end. The stud 1558 is configured to be removably inserted into and withdrawn from a mating receptacle 1564 that is disposed in the extension 1530 (as shown in partial cross section). The stud 1558 and receptacle 1564 are configured, in this illustrative example, to mateably engage in a substantially close fitting arrangement (i.e., what may be referred to as a "snap-fit"), as shown in FIG. 16.

Portions of the extension 1530 are elastically deformed as the stud 1558 is pushed into and then captured by the receptacle 1564 during attachment of the cover to the extension. During detachment, portions of the extension are elastically deformed as the stud 1558 is removed from the receptacle 1564. A single stud and mating receptacle may also be utilized with each cover and extension in some cases. However, multiple studs and receptacles may be expected to be used in many typical implementations in which two or more studs are disposed along the long axis of the cover, and receptacles are disposed in corresponding opposite locations along the long axis of the extension. The studs may also be disposed along the long axis of each of the extensions and the mating receptacles disposed in corresponding locations in each cover in an alternative embodiment. In some implementations, studs and mating receptacles can be disposed in both the extensions and covers, for example, in an alternating or other arbitrary arrangement.

Figure 17:
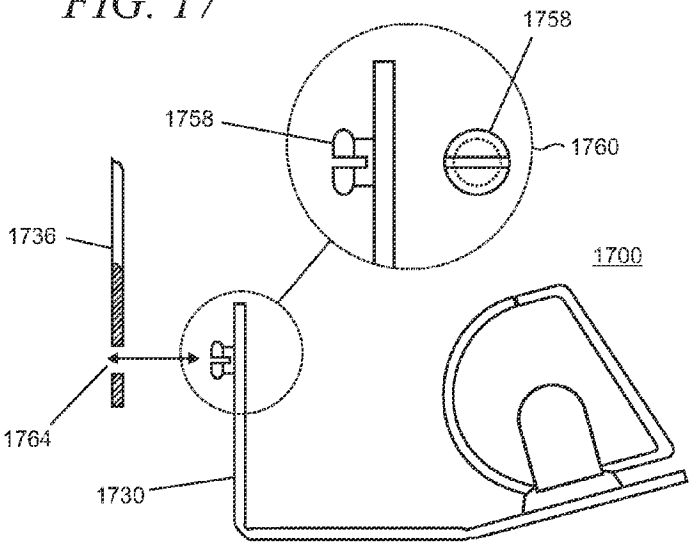
FIGS. 17 and 18 show an illustrative example of an attachment/detachment arrangement using a mating slotted post and through hole.
Figure 18:
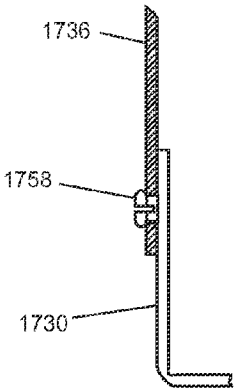

FIG. 17 shows an illustrative arrangement by which a cover 1736 of a D ring binder 1700 may be attached and detached from an extension 1730 using a mating post and through hole. A split post 1758 (shown in two enlarged detail views as indicated by reference numeral 1760) has a narrow portion proximal to the extension and a wider portion at the post's distal end. The split post 1758 is configured to be removably inserted into and withdrawn from a mating hole 1764 through the cover 1736 (shown in partial cross section). In this example, the hole 1764 is sized slightly larger than the narrow portion of the split post 1758 so that the post and hole may mateably engage using a snap-fit as shown in FIG. 18.

The split in the post 1758 can facilitate the necessary elastic deformation that enables the post to be guided through the hole 1764 during assembly and disassembly of the cover 1736 and extension 1730. Multiple split posts and holes may be utilized in typical implementations in which two or more split posts are disposed along the long axis of the extension, and through holes are disposed in corresponding opposite locations along the long axis of the cover.

Figure 19:
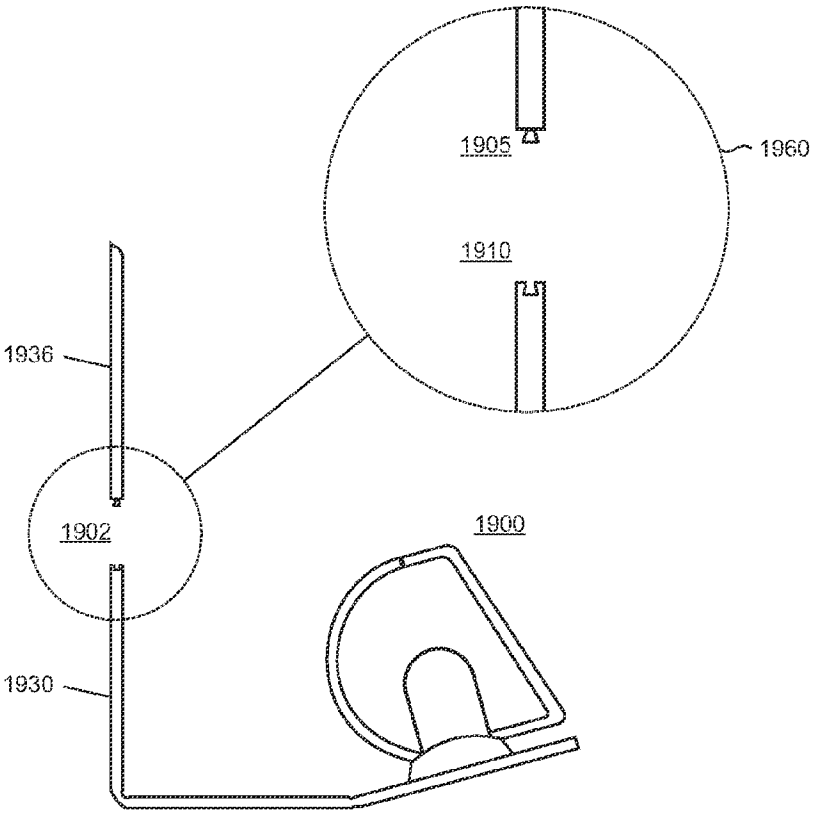

FIG. 19 shows an illustrative arrangement by which a cover 1936 of a D ring binder 1900 may be attached and detached from an extension 1930 using a dovetail joint 1902. The dovetail joint (shown in enlarged detail as indicated by reference numeral 1960) is configured using a tail portion 1905 and a mating slot 1910 having a pin shape (i.e., trapezoidal shape), as shown. The tail portion 1905 and slot portion 1910 may be respectively disposed along substantially the entire length of the cover 1936 and extension 1930. Alternatively, the tail and slot portions may be disposed along just portions of the cover and extension.

Figure 20:
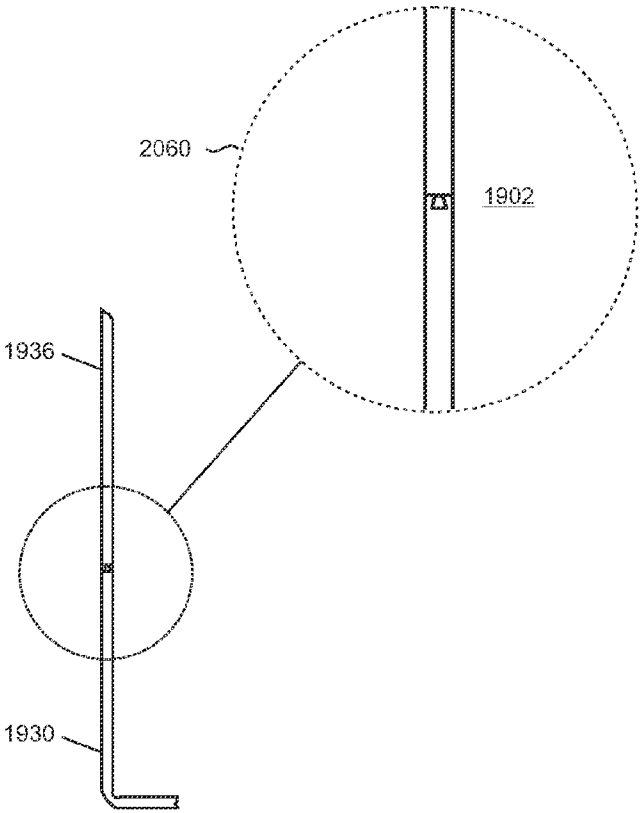
FIGS. 19-23 show an illustrative example of an attachment/detachment arrangement using a dovetail joint.

In this example, the tail portion is disposed in the cover 1936 and the slot portion is disposed in the extension 1930, however, the disposition of the dovetail joint portions in the cover and extension could also be reversed in some implementations. FIG. 20 shows the details of the assembled dovetail joint 1902 in an enlarged view as indicated by reference numeral 2060. Typically, friction between the tail and slot portions in the dovetail joint 1902 is sufficient to securely hold the cover 1936 to the extension 1930.

Figure 23:
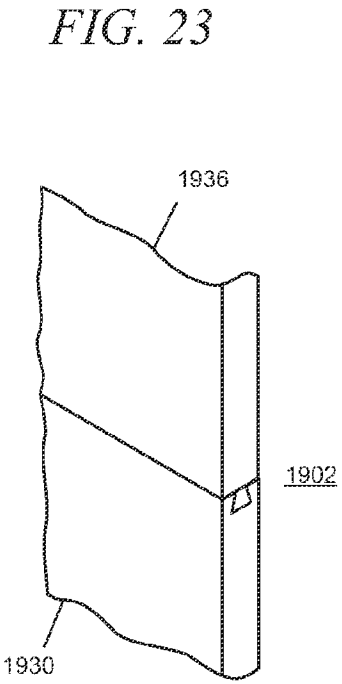
Figure 22:
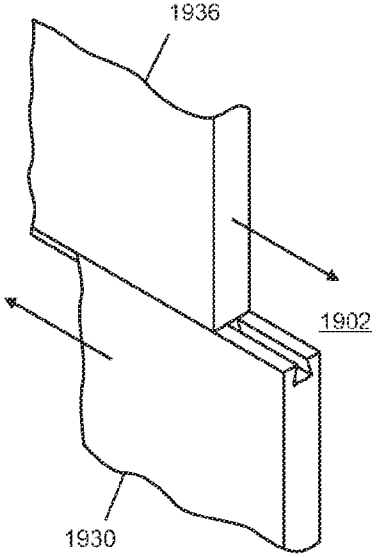
Figure 21:
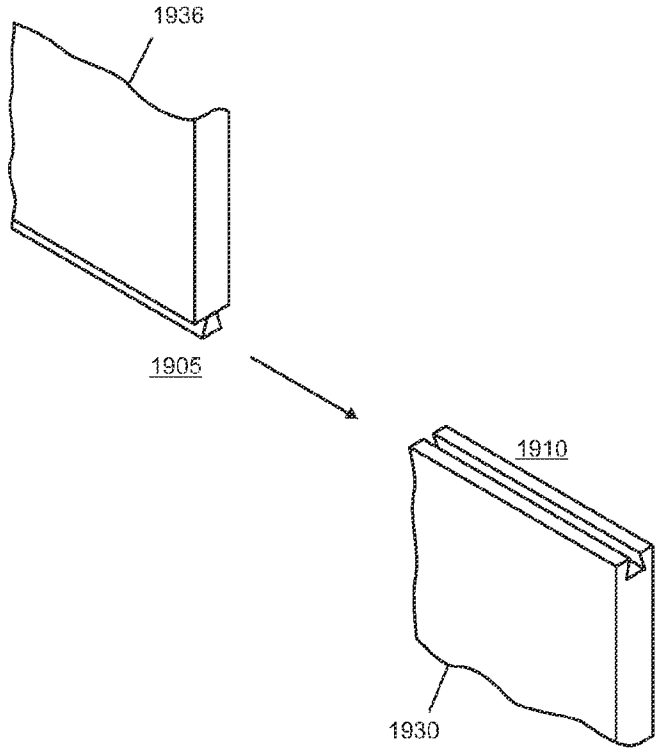

FIGS. 21-23 show an illustrative assembly sequence for the D ring binder 1900. As the partial isometric views of the cover 1936 and extension 1930 in FIGS. 21-23 show, the dovetail joint 1902 is formed when a user guides the tail portion 1905 into the slot portion 1910 (FIG. 21). The cover 1936 and extension 1930 are then slideably engaged in opposite directions along their long axes (FIG. 22) until the leading edge of the cover 1936 is aligned with the trailing edge of the extension 1930 (FIG. 23). In some implementations, a feature (not shown) can be located in the slot portion 1910 that operates as a positive stop to facilitate alignment of the cover and extension.

Figure 25:
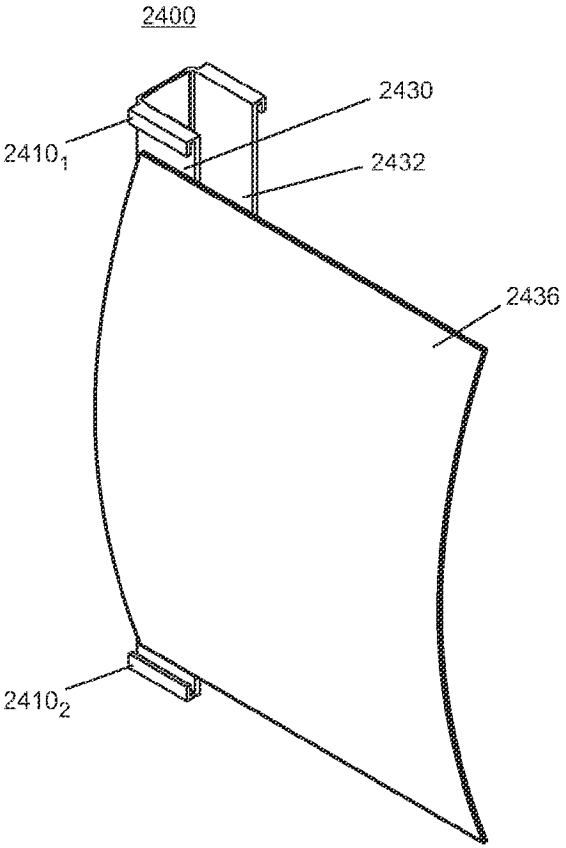
FIGS. 24-28 show an illustrative example of an attachment/detachment arrangement using channels that capture the edges of a cover.
Figure 24:
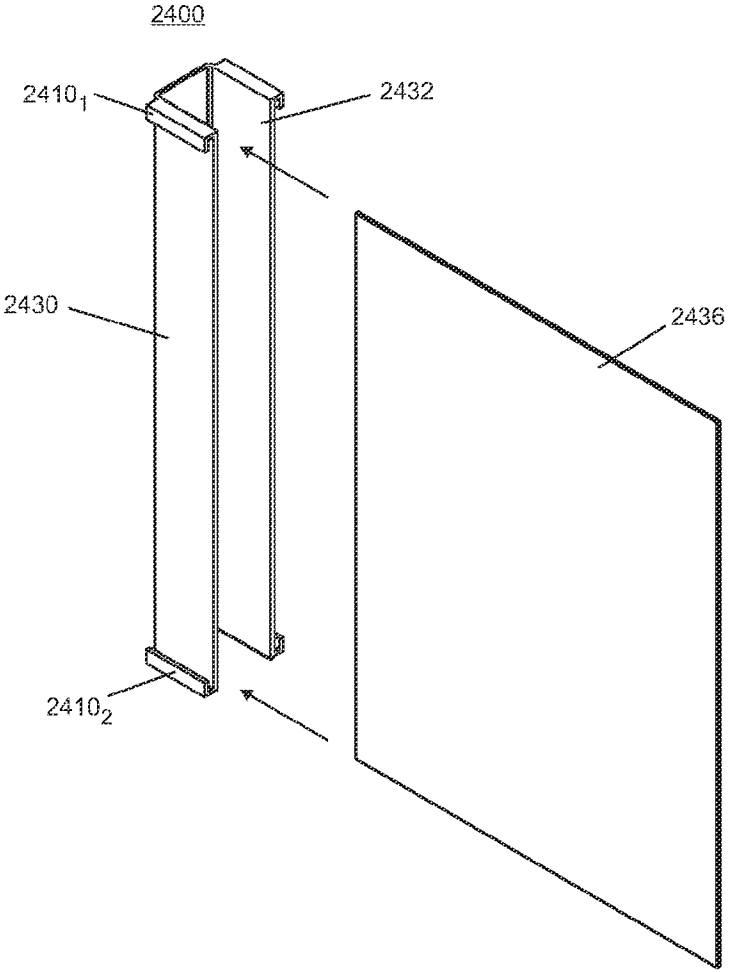

FIG. 24 shows an illustrative arrangement by which a cover 2436 of a ring binder 2400 (where the rings are not shown for purposes of clarity) may be attached and detached from a front extension 2430 using a pair of channels to capture the edges of the cover. The channels $\mathbf{2410}_1$ and $\mathbf{2410}_2$ are disposed on opposing ends of the extension 2430 and project outwardly from the face of the extension. The channels 2410 are configured to mateably engage with edge portions of the cover 2436. The cover 2436 may be slideably inserted into the channels 2410 by a binder user. In some implementations, a feature (not shown) may be located at the trailing portion of the channels 2410 to facilitate alignment of the cover and extension. Alternatively, as shown in FIG. 25, the cover 2436 may be configured to be sufficiently flexible, in some applications, so that a binder user may insert the cover into the channels 2410 along the cover's top and bottom edges.

Figure 27:
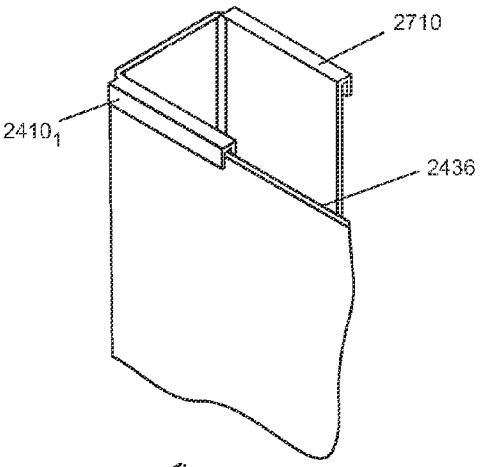
Figure 28:
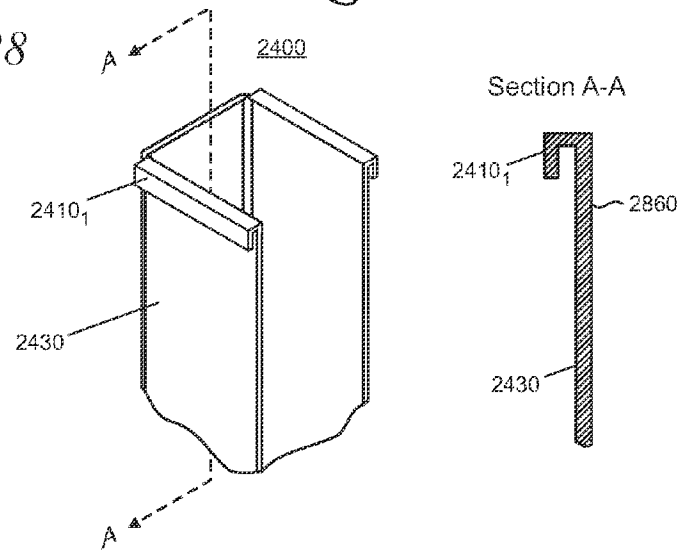
Figure 26:
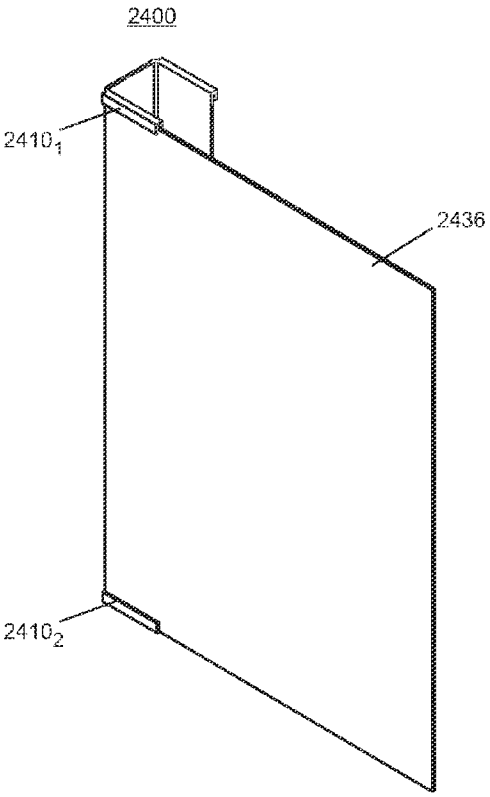
Figure 30:
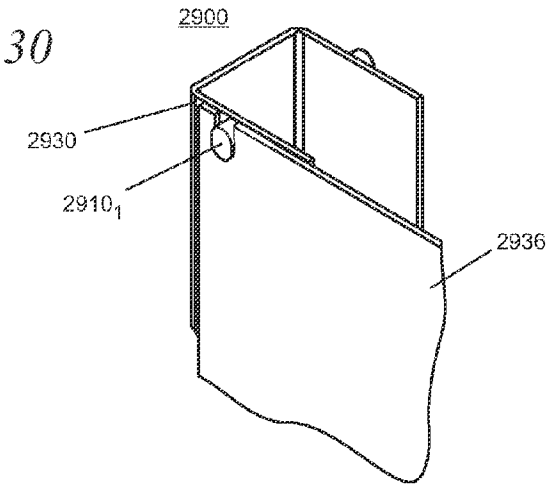
FIGS. 29-31 show an illustrative example of an attachment/detachment arrangement using undercut posts that capture slots in a cover.

A friction fit between the cover 2436 and channels 2410 secures the cover to the extension 2430 when assembled to the ring binder 2400 as shown in FIG. 26. FIG. 27 shows the top channel $\mathbf{2410}_1$ on extension 2430 and a corresponding top channel 2710 that is configured for mateable engagement with the back cover (not shown) in an enlarged partial view. FIG. 28 shows a partial sectional view of channel $\mathbf{2410}_1$ and extension 2430 as indicated by reference numeral 2860.

Figure 31:
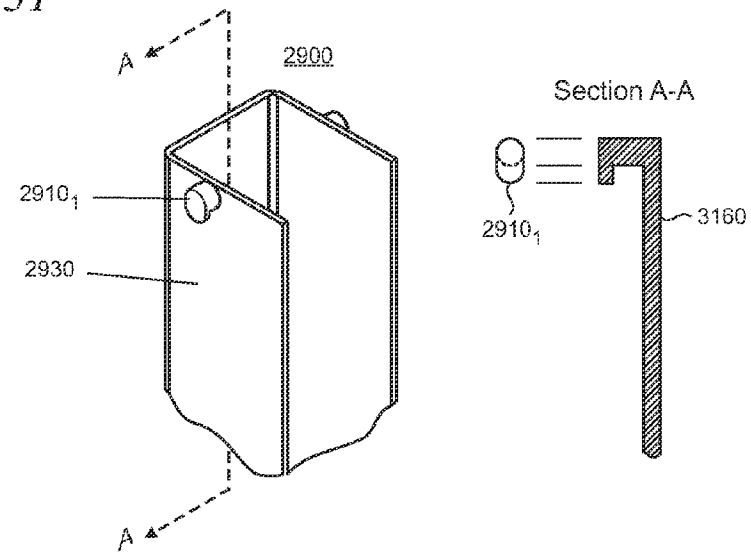
Figure 29:
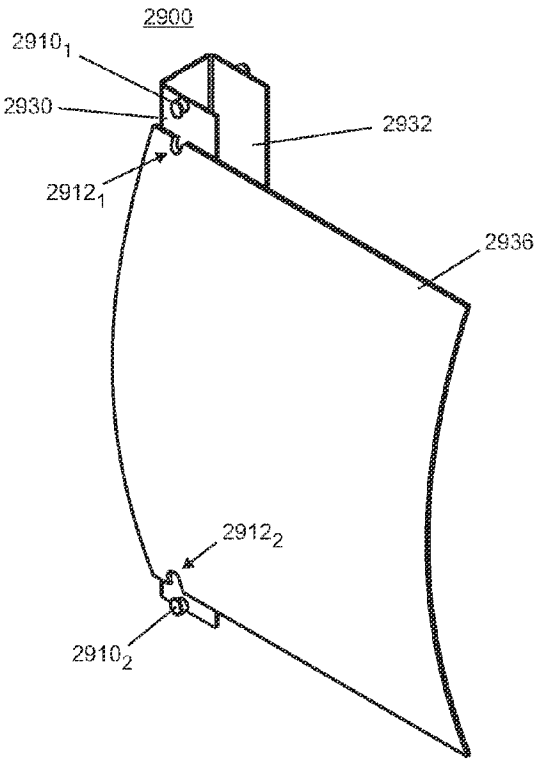

FIG. 29 shows an illustrative arrangement by which a cover 2936 of a ring binder 2900 (where the rings are not shown for purposes of clarity) may be attached and detached from a front extension 2930 using a pair of undercut posts. The posts $\mathbf{2910}_1$ and $\mathbf{2910}_2$ are disposed on opposing ends of the extension 2930 and project outwardly from the face of the extension. The posts 2910 are configured to mateably engage with respective slots $\mathbf{2912}_1$ and $\mathbf{2912}_2$ that are located at the top and bottom edges of the extension 2930. Typically, the cover 2936 is configured to be sufficiently flexible to allow a user to position the slots 2912 to engage with the undercut portions of the posts 2910, as representatively shown in the enlarged partial view shown in FIG. 30. FIG. 31 shows a front view of the post $\mathbf{2910}_1$ along with a partial sectional view of post $\mathbf{2910}_1$ and extension 2930, as indicated by reference numeral 3160.

Figure 32:
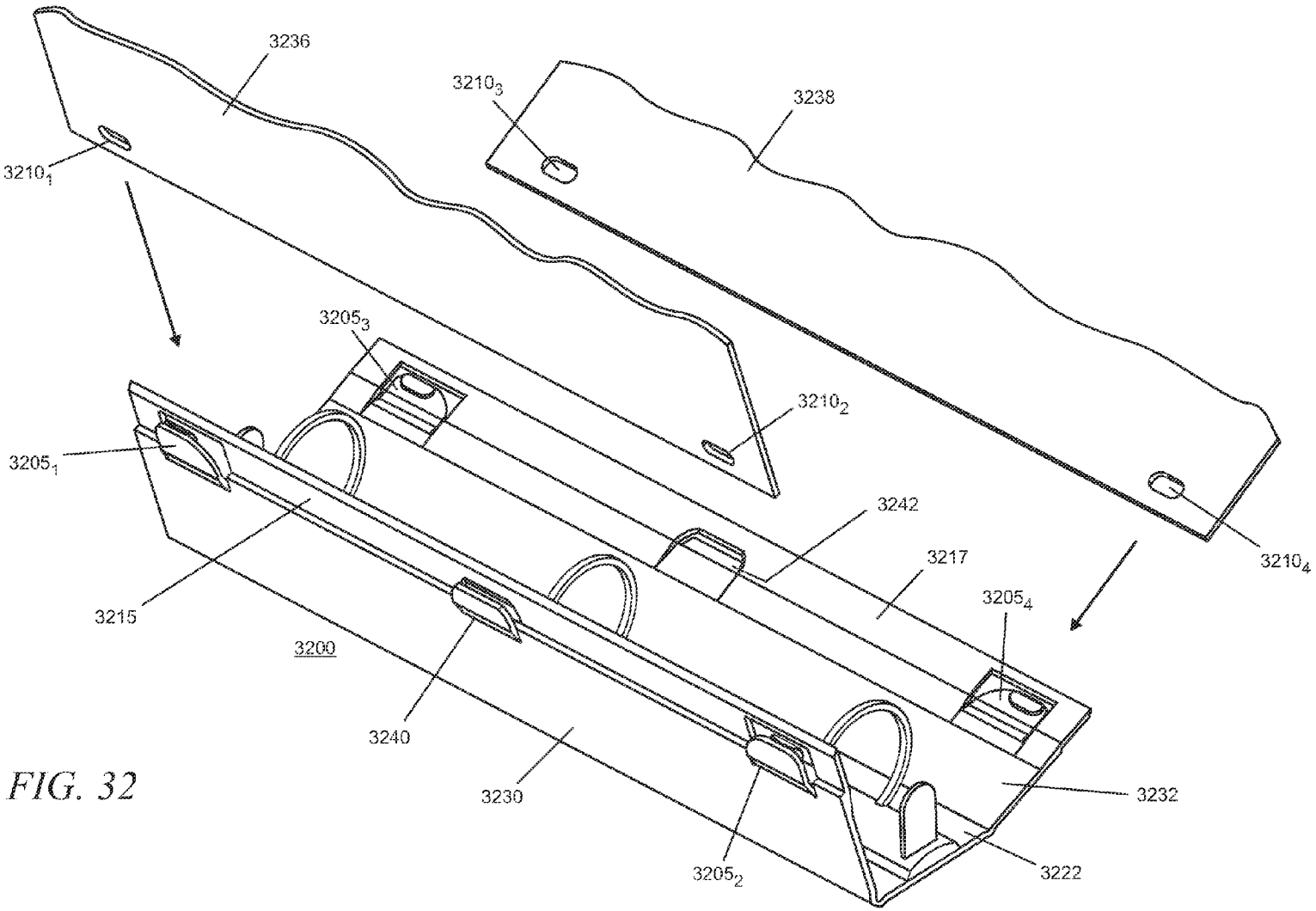
FIGS. 32-39 show an illustrative example of an attachment/detachment arrangement using snap-fit fasteners that mateably engage with through holes in a cover.

FIG. 32 shows an illustrative arrangement by which a front cover 3236 and back cover 3238 may be attached and detached from respective front extension 3230 and back extension 3232 in a circular ring binder 3200 using snap-fit fasteners $\mathbf{3205}_{1\text{-}4}$. The extensions 3230 and 3232 are hingedly attached to a spine 3222. In this particular example, the extensions are formed in a unitary manner with the spine 3222 using living hinges as shown in FIG. 9 and described in the accompanying text. While a ring binder is shown in FIG. 32, it will be appreciated by those skilled in the art that the principles described herein may be readily adapted to D ring binder configurations as well.

In this example, the snap-fit fasteners 3205 are located towards the top and bottom edges of each of the extensions and are configured for mateable engagement with respective through holes $\mathbf{3210}_{1\text{-}4}$ in the covers. The through holes 3210 are configured with rounded short edges to avoid stress concentrations in the covers that would otherwise be expected in corners having small radii.

The location of the fasteners 3205 towards the top and bottom edges can typically be expected to enable binder users to readily reach the fasteners 3205 with their fingers when the covers are attached in order to disassemble the covers from the binder. In alternative arrangements, additional snap-fit fasteners can be used in intermediate locations along the distal edge between the top and bottom fasteners. As shown, the snap-fit fasteners 3205 project slightly outwardly from the face of each extension 3230 and 3232 and are arranged opposite respective retaining flanges 3215 and 3217 that project distally from each extension's opposite face. The retaining flanges 3215 and 3217 run substantially along the distal long edge of the extensions 3230 and 3232 in this example. Alternatively, the retaining flanges may be configured in some instances to run partially along the long edges of the flanges.

The snap-fit fasteners 3205 and opposing retaining flanges 3215 and 3217 form a channel that is sized to have a nominal width that is approximately equal to the thickness of a cover (e.g., cover 3236 and 3238). When the cover is attached, the channel will engage the cover's edge, in some cases with a small degree of interference to assist in securely capturing the cover in a butt joint configuration with the extension. In this example, locating tabs 3240 and 3242 are located approximately midpoint along the long axis of the extensions 3230 and 3232. The locating tabs 3240 and 3242 do not include a snap-fit feature but still form a channel with the retaining flanges 3215 and 3217 to assist in capturing the covers.

Figure 33:
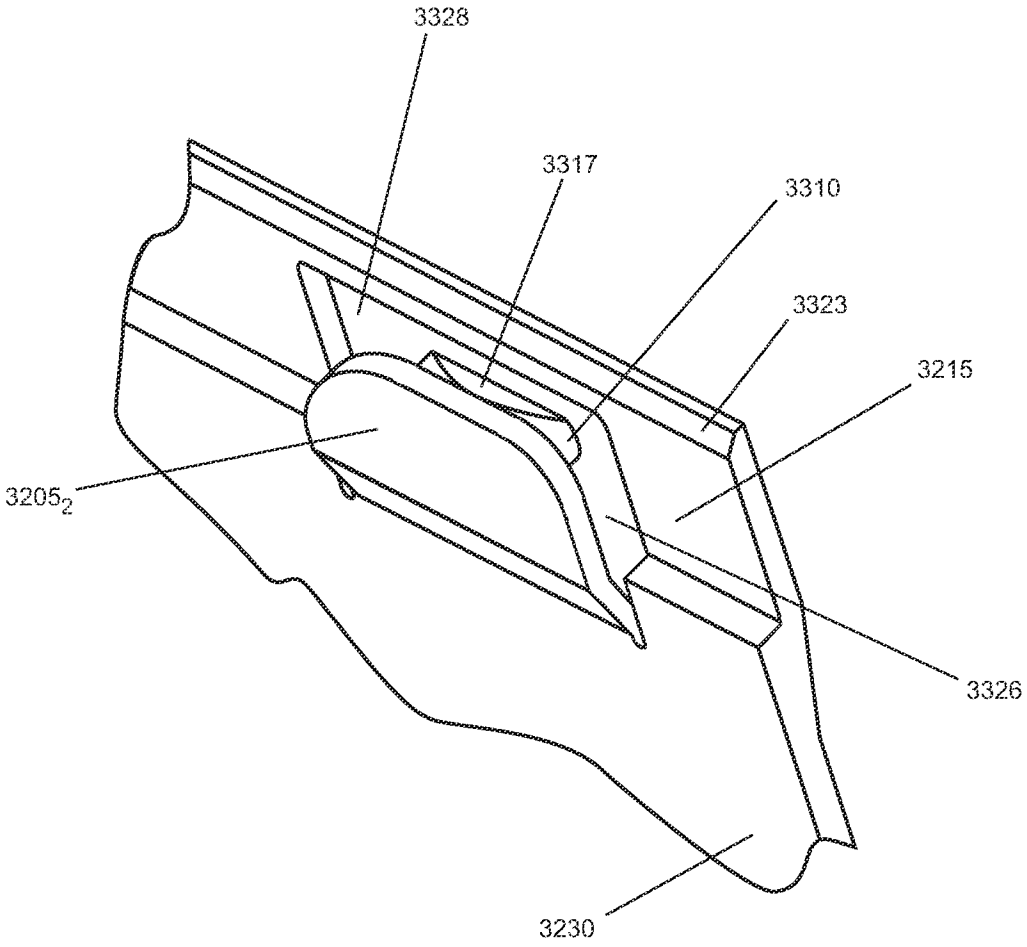

FIG. 33 shows an enlarged partial view of the snap-fit fasteners (as represented by snap-fit fastener $\mathbf{3205}_2$) and retaining flange 3215 on the front extension 3230. A button 3310 projects from the inside face of the fastener 3205. The button 3310 is configured to interface with the through hole 3210 (FIG. 32) in the front cover 3236. Both the button 3310 and retaining flange 3215 include opposing and mirrored beveled features, as respectively indicated by reference numerals 3317 and 3323, to help guide the cover into the channel 3326 formed between the snap-fit fastener 3205 and the retaining flange 3215 when the cover is attached to the extension by the ring binder user.

An opening 3328 is located in the retaining flange 3215 opposite the snap-fit fastener 3205. The opening 3328 provides access to the inside surface of the fastener 3205. The opening also enables the extension along with the snap-fit fasteners and retaining flanges to be injection molded, for example, as a unitary article using a relatively simple straight pull mold, as will be appreciated by those skilled in the art. Similar openings in retaining flanges (not shown) opposite the locating tabs 3240 and 3242 (FIG. 32) may also be configured when the tabs are utilized in a given ring binder design.

Figure 34:
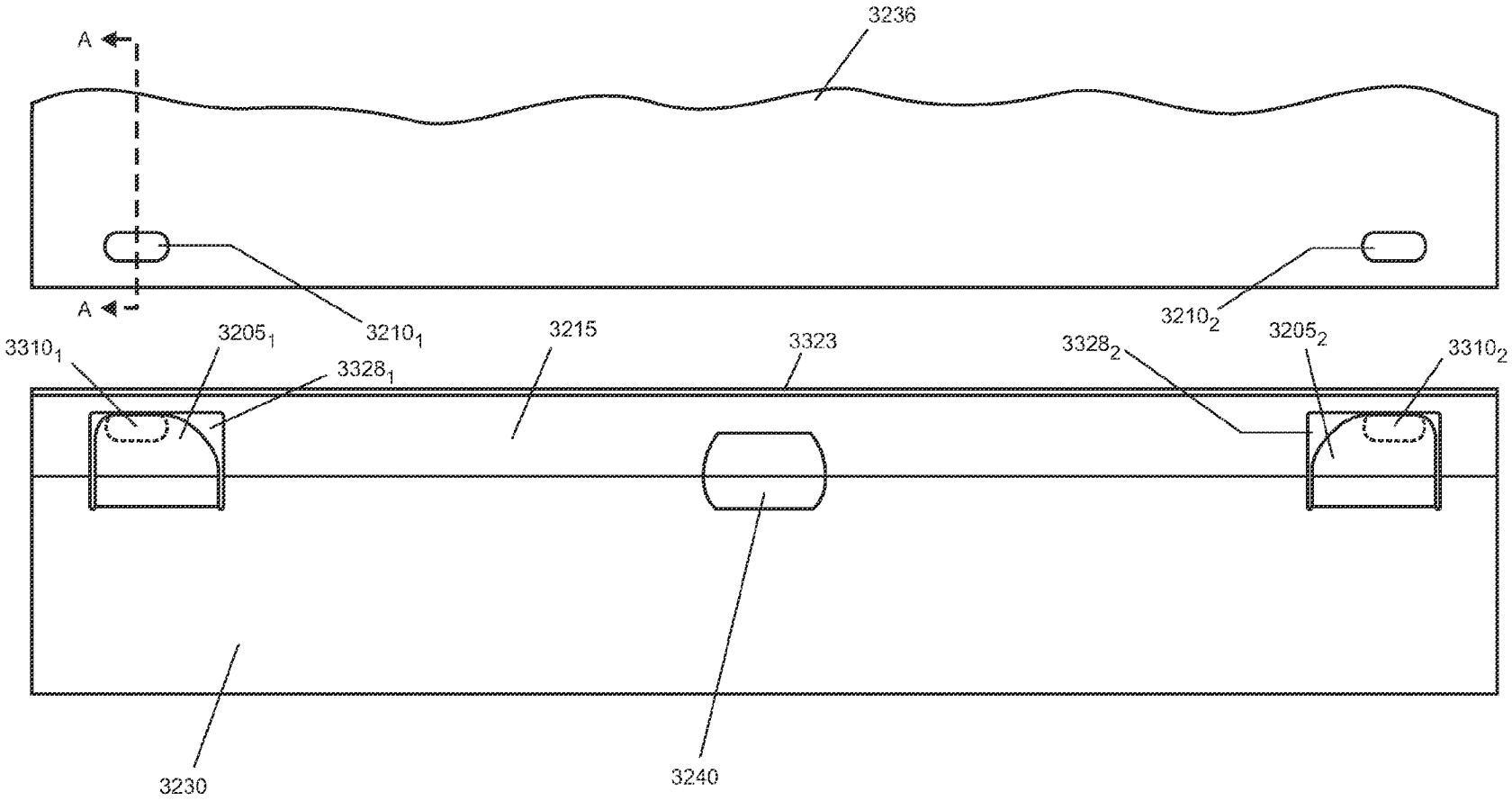
Figure 35:
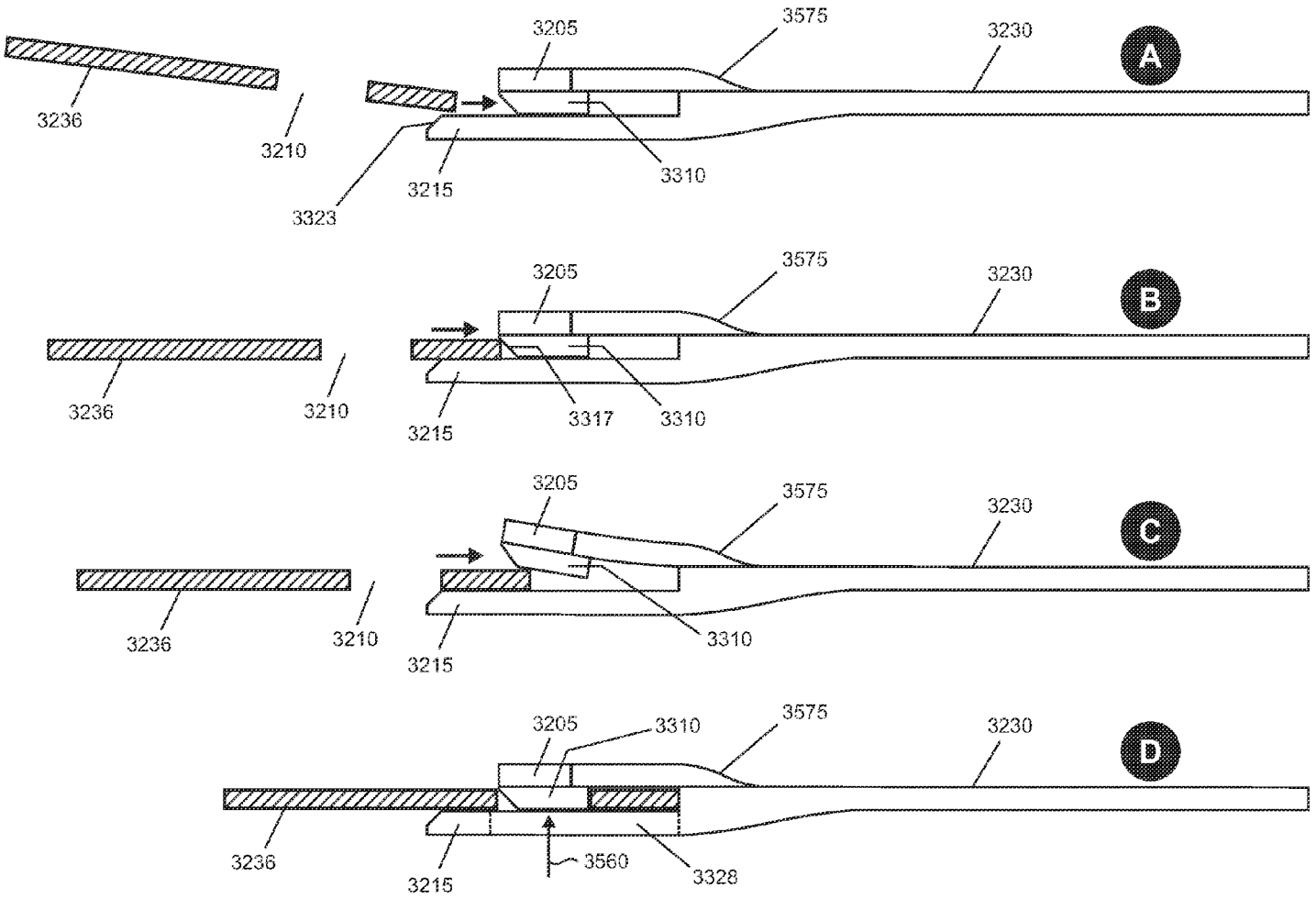

FIG. 34 shows the outside of the front extension 3230 and front cover 3236 in enlarged plan view. FIG. 35 shows a top view of extension 3230 and the front cover 3236 in partial sectional view (along section A-A as indicated in FIG. 34) in a sequence of positions, noted by letters "A" through "D" during the attachment of the cover to the extension. As shown in position "A," a ring binder user guides the cover 3236 towards the extension 3230. The bevel feature 3323 on the retaining flange 3215 may assist in such guidance. In addition, the retaining flange 3215 is configured to outwardly extend beyond the fastener 3205 (towards the left in FIG. 35) to create a lip or ledge feature that facilitates capture of the leading edge of the cover 3236 as the user begins the attachment sequence.

The cover 3236 is moved until its leading edge contacts the bevel feature 3317 of the button 3310 on the fastener 3205 as shown in position "B." As the user continues to push the cover 3236 against the button, the leading edge causes the fastener 3205 to elastically deform as shown in position "C" (although not shown in the drawing for sake of clarity, portions of the retaining flange 3215 may also elastically deform to some degree at this stage in the attachment sequence). The cover 3236 will then bottom out against the distal edge of the extension 3230 as the through hole 3210 simultaneously becomes aligned with the button 3310. The button 3310 then becomes free to capture the cover 3236 in a snap-fit arrangement as the fastener 3205 is substantially restored to its original position as shown in position "D." In some implementations, the snap-fit fastener 3205 may be configured to remain partially stressed when the cover 3236 is attached to the extension 3230 so that a clamping force is exerted on the cover to help keep it secure.

As shown in position "D," the cover 3236 and extension 3230 are configured in a butt-joint arrangement when attached. The user can detach the cover 3236 from the extension 3230 by pushing against the button 3310, as indicated by arrow 3560 to release the through hole 3210 from the fastener 3205. As noted above, the button 3310 is accessible to the user through the opening 3328 (shown in dotted line phantom view).

FIG. 35 also highlights an additional feature of the fastener 3205 in which a rear portion of the fastener (i.e., opposite the end of the fastener having the beveled edge on the button 3310) is configured with a sloping transition to the flat plane of the front surface of extension 3230. The sloped transition feature is indicated by reference numeral 3575. A similar sloped transition feature may typically be included in the locating tabs 3240 and 3242 (not shown in FIG. 35) in many embodiments. The sloped transition features can help prevent adjacent binders from getting caught on a sharp edge when sliding past each other on a shelf or in packaging.

Figure 36:
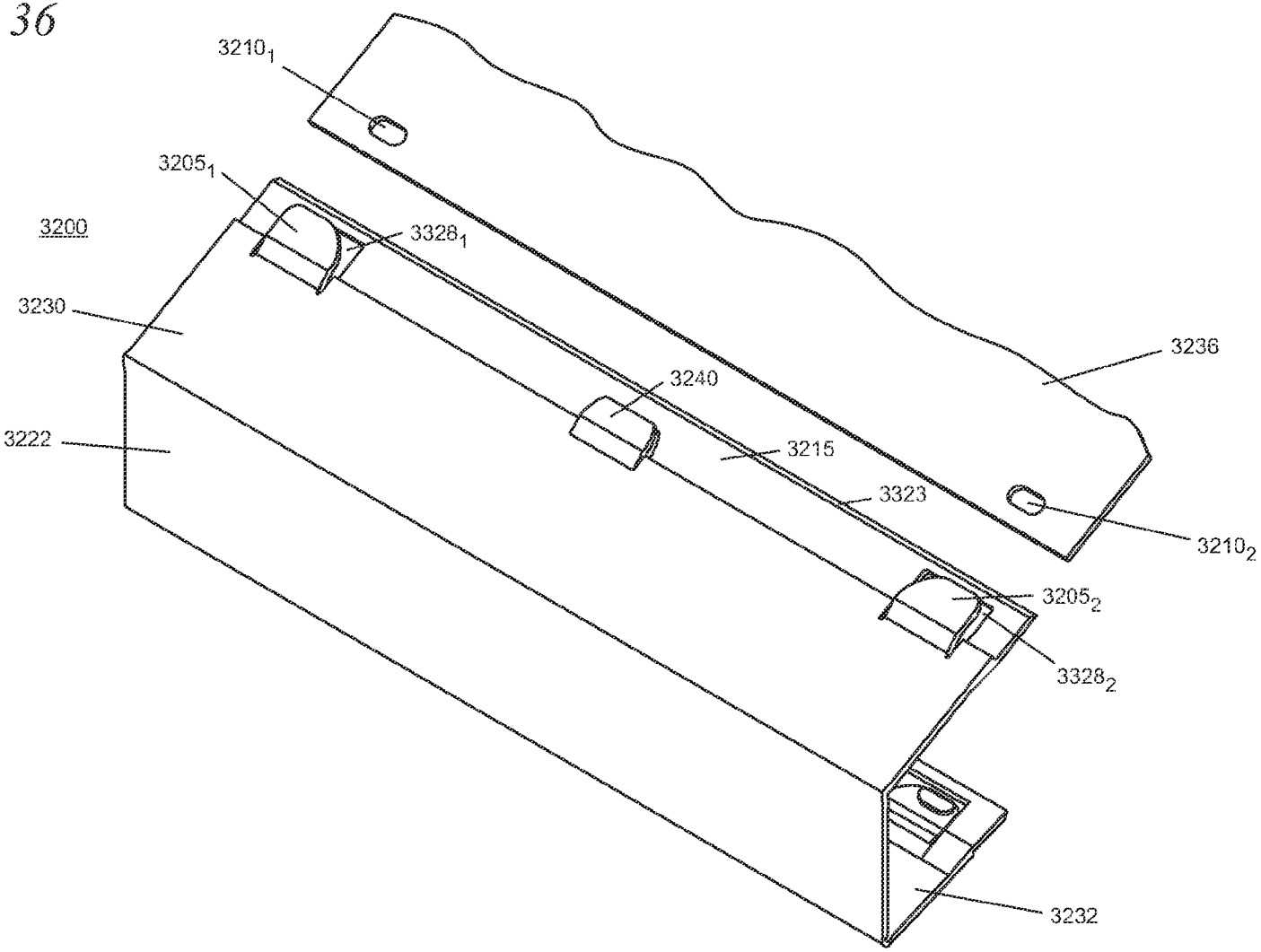
Figure 37:
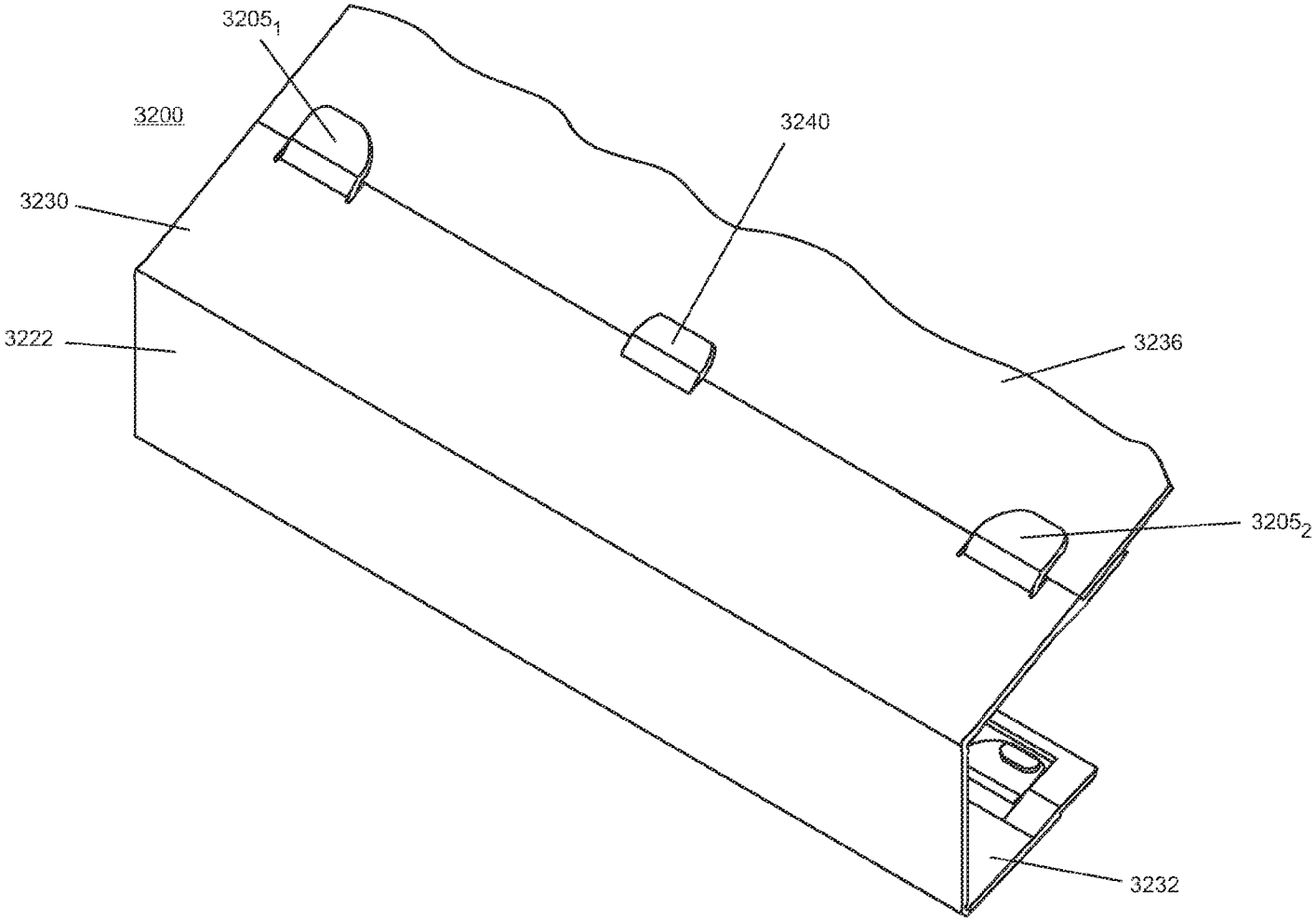

FIG. 36 shows another view of the ring binder 3200 (in which the rings and associated mechanisms are not shown to enhance clarity). FIG. 37 shows the ring binder 3200 with the front cover 3236 attached to the front extension 3230.

Figure 38:
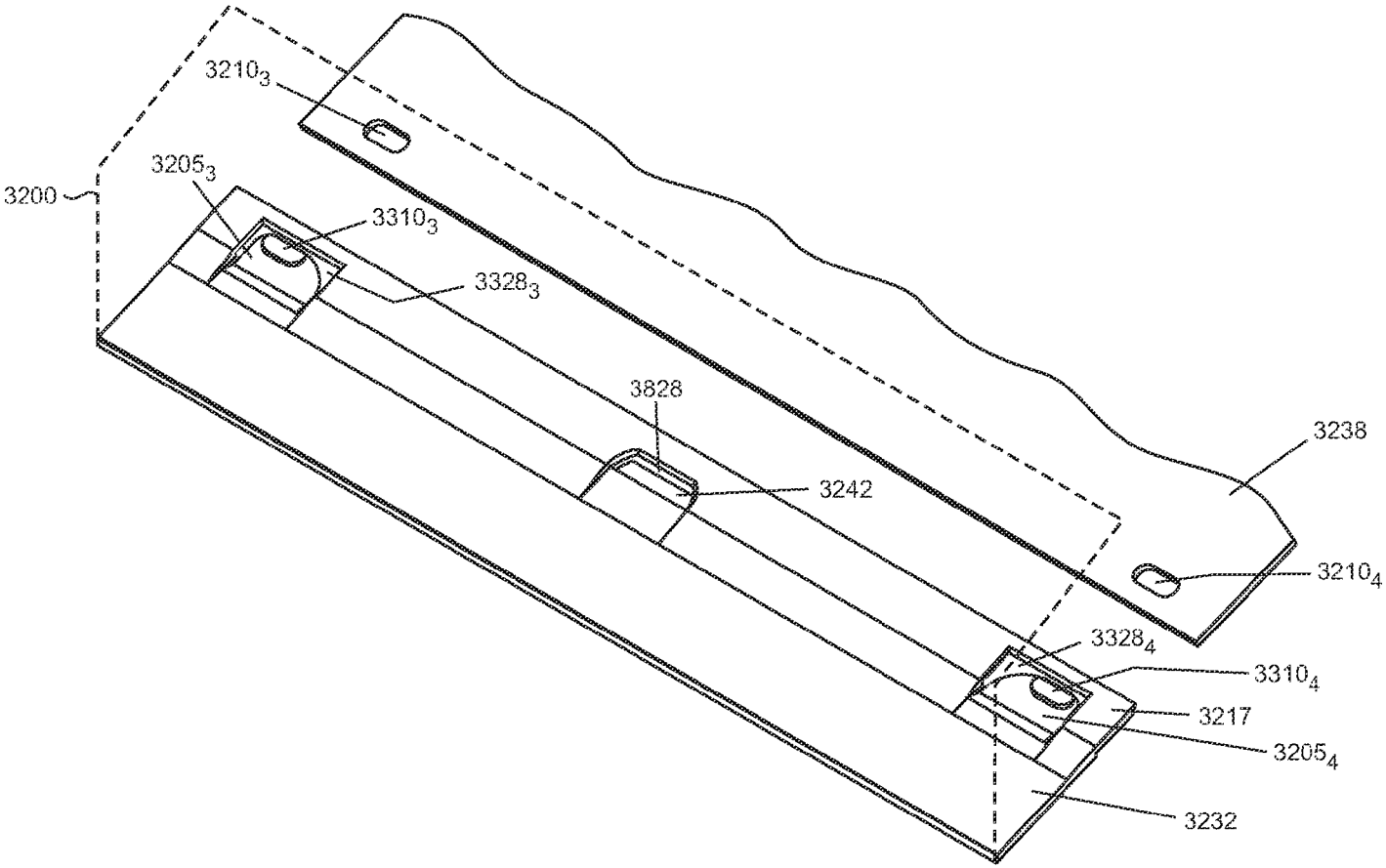
Figure 39:
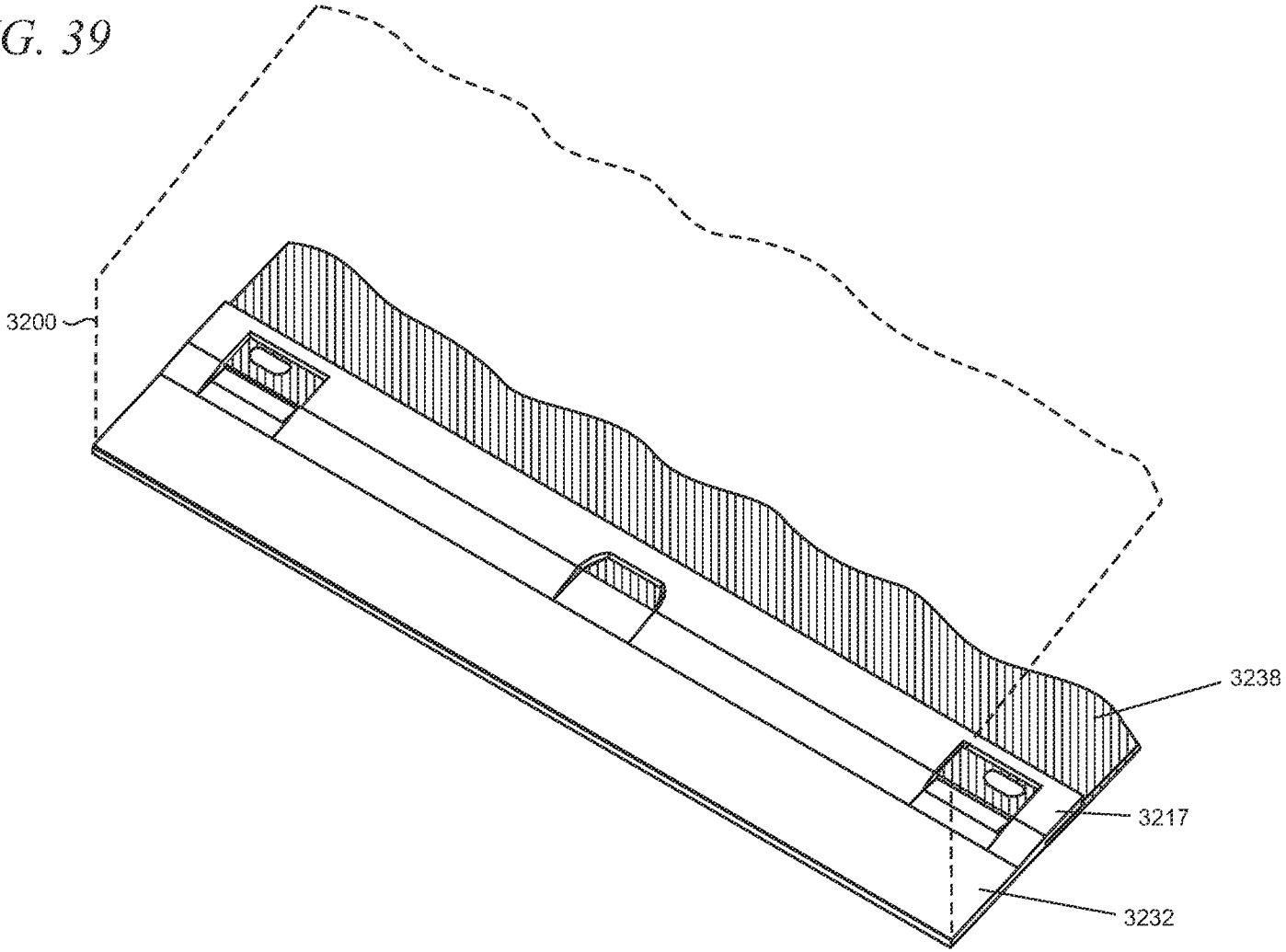

FIG. 38 shows a view of the inside surfaces of the back extension 3232 with the back cover 3238 detached (with the remainder of binder 3200 shown in dotted line phantom view). This view also shows the opening in the retaining flange 3217 described above (as indicated by reference numeral 3828) that is opposite the locating tab 3242. FIG. 39 shows the ring binder 3200 with the rear cover 3238 attached to the back extension 3232. In this view the cover 3238 is hatched to highlight the interface between the cover and the extension 3232.

The attachment arrangement shown in FIGS. 32-39 and described in the accompanying text above advantageously enables the covers 3236 and 3238 to incorporate the relatively simple through holes to facilitate attachment to the respective extensions 3230 and 3232. The through holes can be straightforward to fabricate, for example using a punch on plastic sheet stock. In addition, by disposing the hinges between the spine 3222 and the respective extensions 3230 and 3232 (where the spine and hinges are integrally formed in many applications), the particular materials selected for the respective spine/extensions and covers can be optimized by function. For example, a relatively high grade of polypropylene may be used for the molded spine/extensions so that the living hinge is robust and resistant to fatigue while the covers can be formed from a relatively low grade of polymer, including recycled materials. Such optimization of selected materials can be expected to result in significant cost savings in many typical applications.

Figure 40:
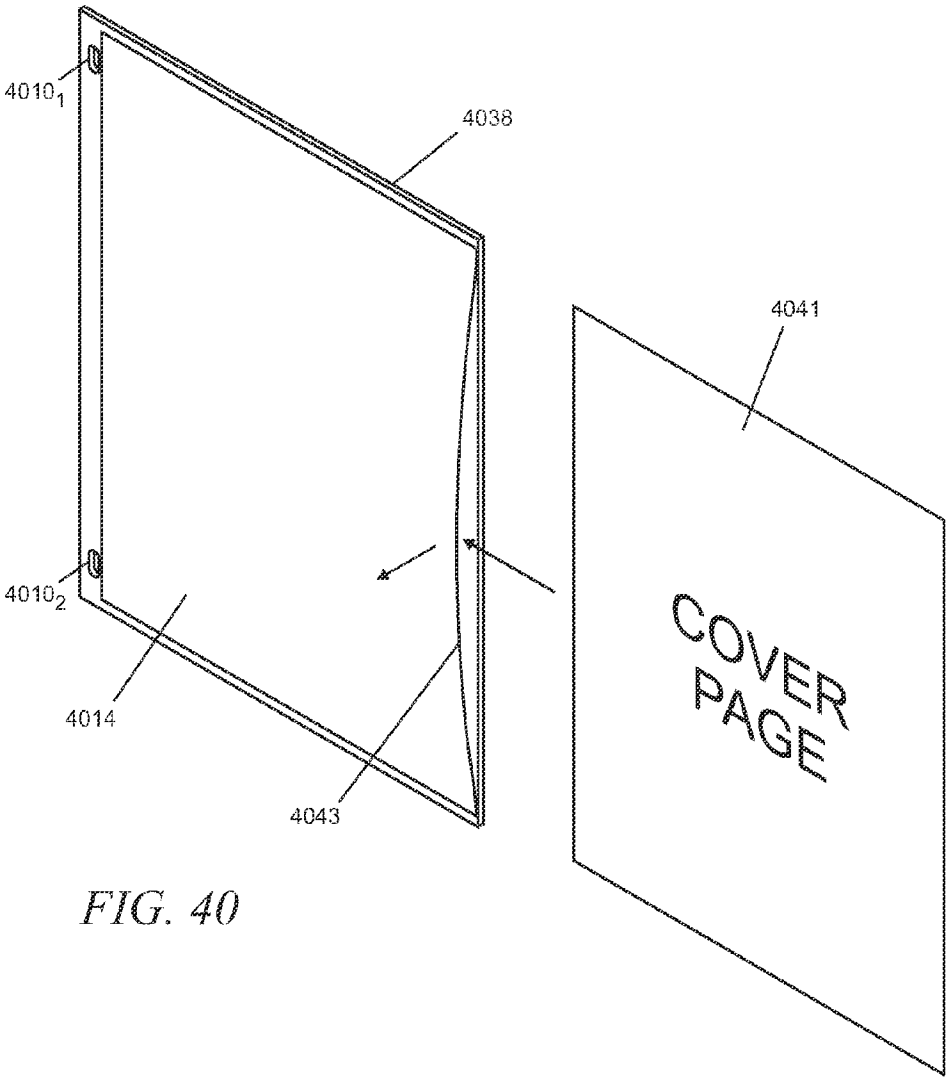

FIG. 40 shows an illustrative front cover 4038 that is configured with through holes 4010 along its proximal edge to interface with snap-fit fasteners as described above. The cover 4038 includes a clear or translucent plastic overlay 4014 which is fastened at the top and bottom and proximal edge of the cover. The overlay 4014 is unfastened along the distal edge of the cover 4038. The overlay 4014 thus forms a pocket having its opening along the cover's distal edge.

Figure 41:
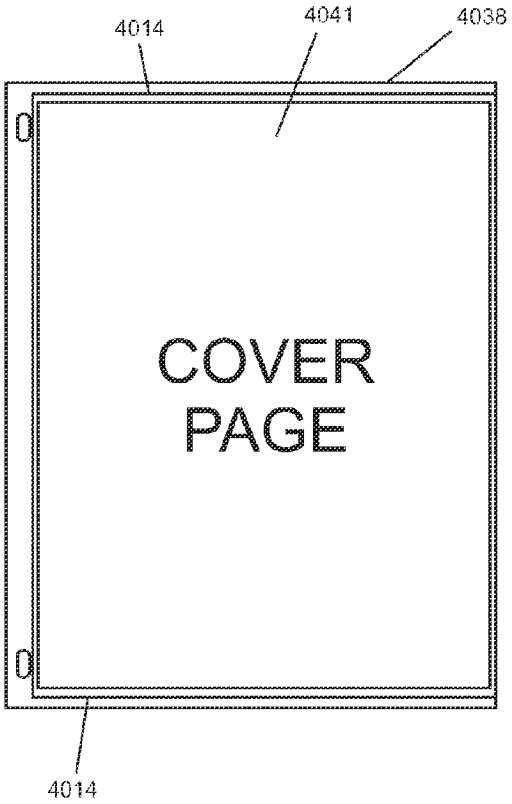
FIGS. 40 and 41 show a cover having a clear or translucent plastic overlay that may be used as part of a view binder.

The overlay 4014 enables the cover 4038 to be part of what is commonly referred to as a "view binder" with which a user may insert a user-generated cover page 4041 (e.g., a piece of paper with print, graphics, etc.) and insert it between the inside surface of the overlay and outside surface of the cover. Typically the overlay 4014 is arranged from a flexible material so that the user can pull its distal edge 4043 slightly away from the cover 4038 to allow the leading edge of the cover page to be readily inserted into the opening. FIG. 41 shows a view of the outside of the front cover 4038 with the fully inserted cover page 4041.

Figure 43:
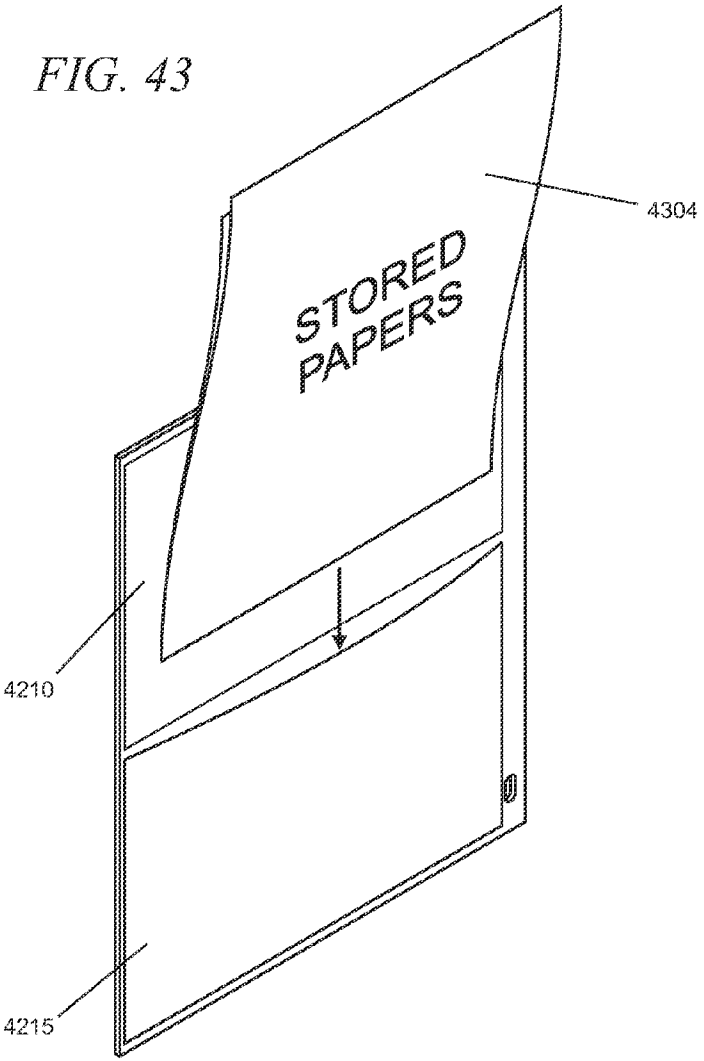
Figure 42:
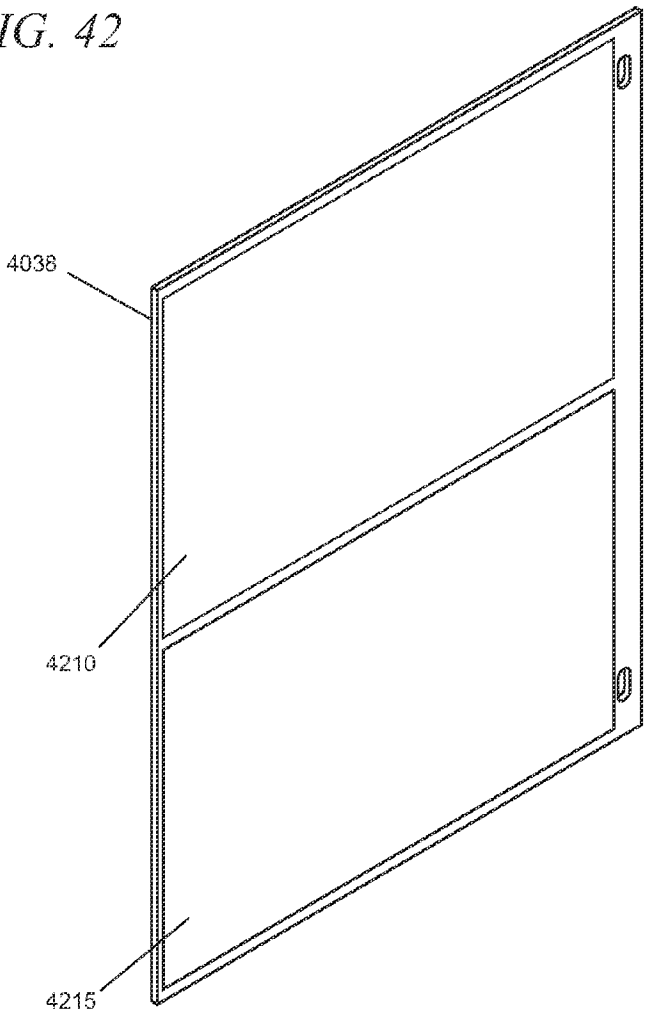

FIG. 42 shows a view of the inside of the front cover 4038. Two pockets 4210 and 4215 are disposed on the inside of the cover. The pockets are typically arranged to provide some additional storage for papers and similar items. A user pulls the edge of a pocket at its opening to allow papers 4304 to be placed inside, as shown in FIG. 43.

The opening for the top pocket 4210 is located at its bottom and the opening for the bottom pocket 4215 is located at its top as indicated by the dashed lines 4412 and 4418 in FIG. 44. By configuring the openings to oppose one another, the cover 4038 can be oriented with the through holes 4010 to either the right or left while still supporting a pocket with an opening in the proper orientation for use, as shown in FIG. 45. As the overlay 4014 (FIG. 40) on the outside of the cover 4038 can also be used in either orientation, a single cover design may be advantageously used as either a front or back cover while maintaining both the view binder and storage pocket features.

Figure 47:
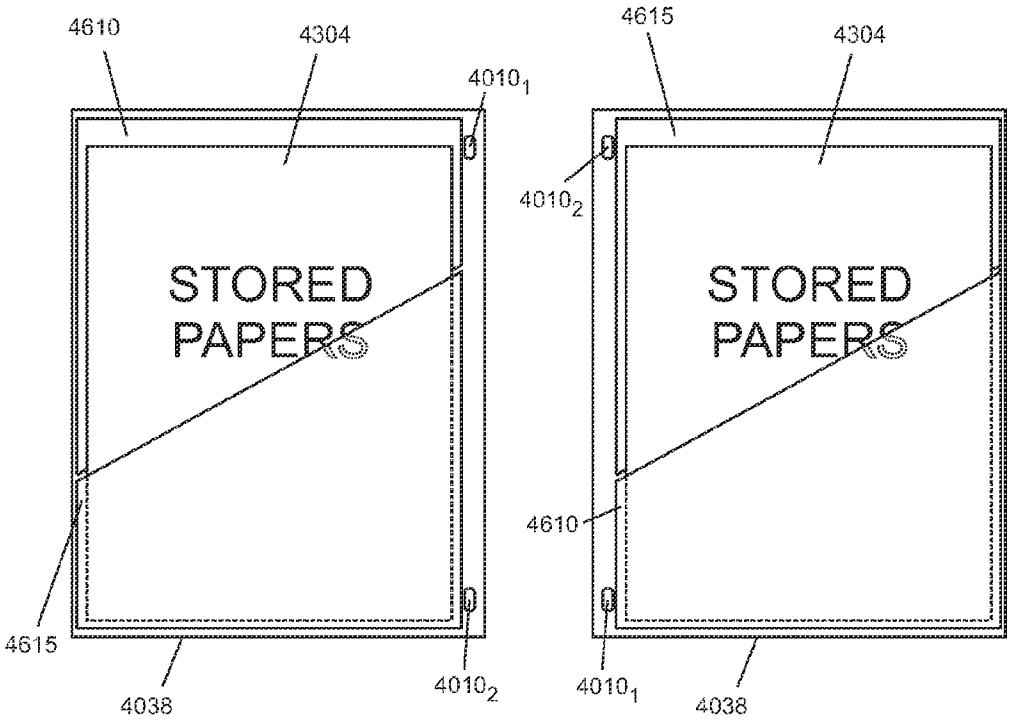
Figure 46:
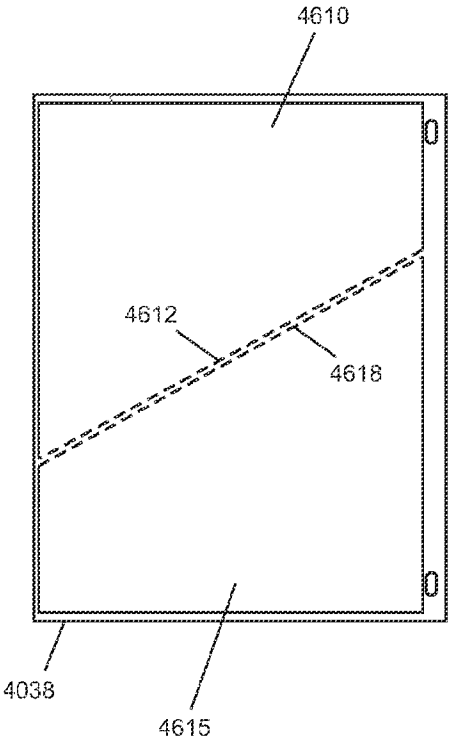

FIG. 46 shows an alternative configuration for a top pocket 4610 and a bottom pocket 4615 that have openings that are positioned diagonally and are located opposite one another in a similar manner to the pockets shown in FIGS. 42-45. The opening to the top pocket 4610 is indicated by the dashed line 4612 and the opening to the bottom pocket 4615 is indicated by the dashed line 4618. As with the pockets shown in FIG. 42, the diagonal pockets enable a pocket feature to be supported regardless of the orientation of the cover 4038, as shown in FIG. 47.

While the cover designs shown in FIGS. 40-47 and described in the accompanying text incorporate both the view binder and storage pocket features, it is noted that some ring binder manufacturers, retailers, and users may want covers that include some or none of these features. Thus, the present attachable and detachable covers may be alternatively arranged in three different configurations including a plain cover (no view feature and no pockets), a view feature cover only (no pockets), and a combination cover having both the view feature and pockets.

Figure 48:
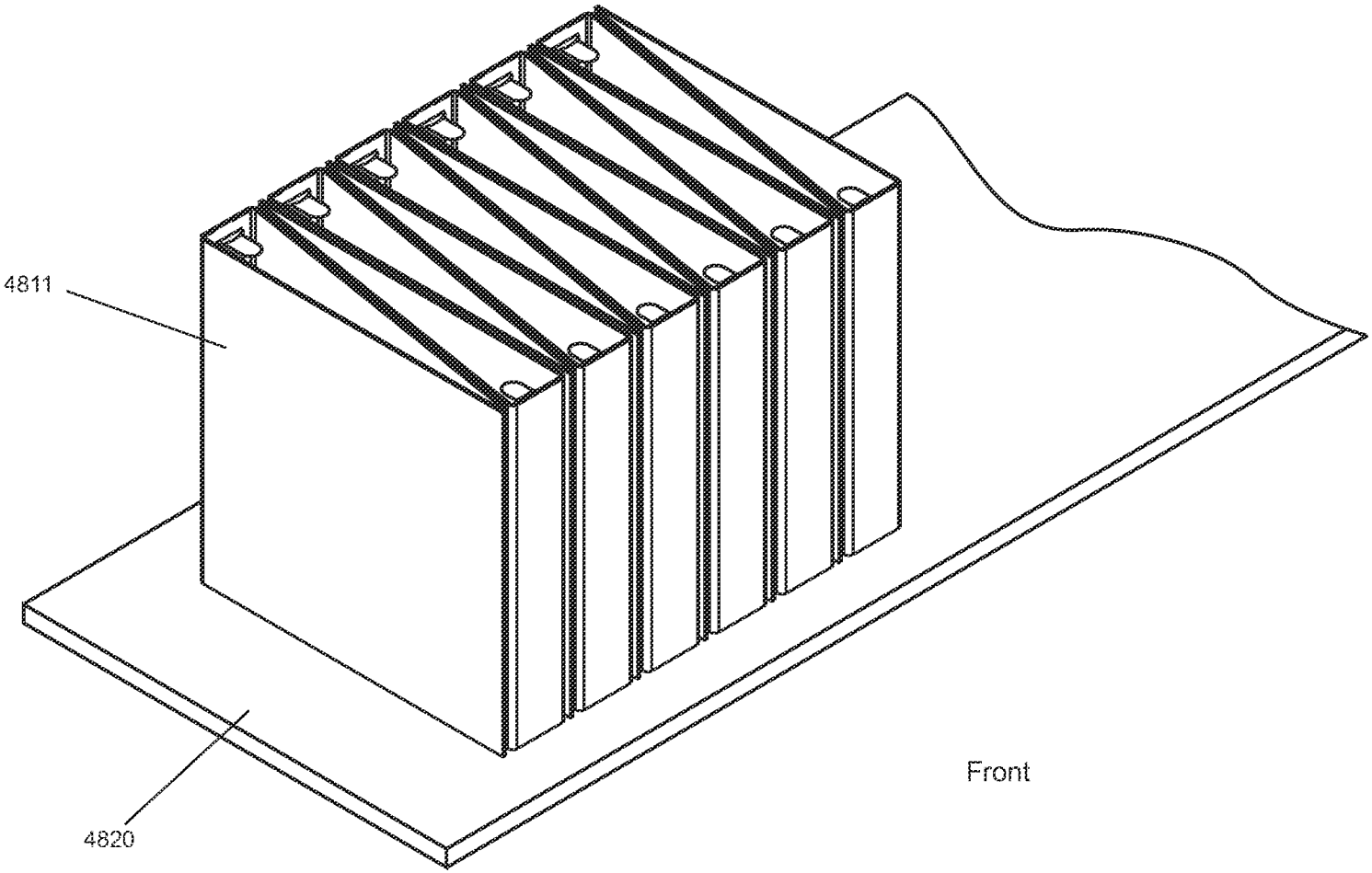
FIGS. 48-50 illustrate typical storage and display practices that are used when dealing with a plurality of conventional ring binders.

FIG. 48 illustrates typical storage and display practices that are used when dealing with a plurality of conventional ring binders 4811 that are known in the art. The conventional ring binders 4811 in this illustrative example are located on a shelf 4820 that might be found at a retail store on either the sales floor or in an inventory storage area. The conventional ring binders 4811 are arranged in an opposing manner where every other binder is reversed in orientation. That is, every other conventional ring binder has its spine facing front (i.e., into the retail or storage space). This practice allows the conventional ring binders to take up less horizontal space on the shelf 4820 than would otherwise be expected if the binders shared the same spine orientation.

Figure 50:
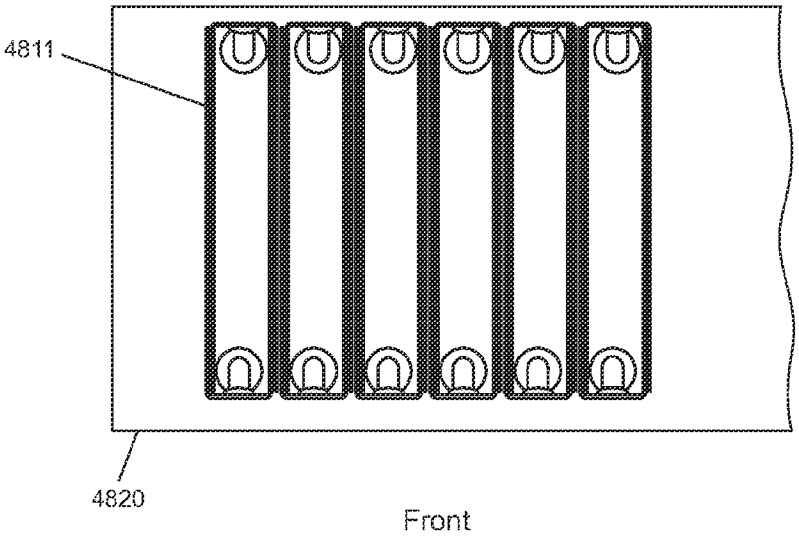
Figure 49:
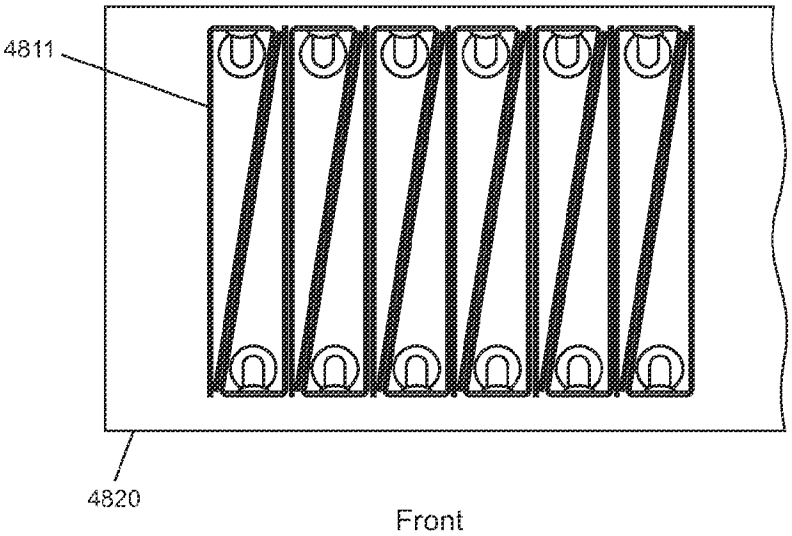

FIG. 49 shows a top view of 12 conventional ring binders 4811 arranged as in FIG. 48 where the spines have alternating orientation. As shown, the covers and spine of the conventional ring binders 4811 form a triangle shape when viewed from the top. FIG. 50 shows an alternative display arrangement in which the spines of adjacent conventional ring binders 4811 have alternating orientation on the shelf 4820 and the covers of adjacent binders are interleaved. Typically, this alternative arrangement results in the covers and spines of the conventional ring binders 4811 forming a roughly rectangular shape when viewed from the top. In some situations, conventional ring binders may be displayed/stored using a combination of triangular and rectangular arrangements on the same shelf Alternating spine orientations are also typically utilized when conventional binders are boxed for shipping as such alternating orientation provides the highest available packing density.

Figure 51:
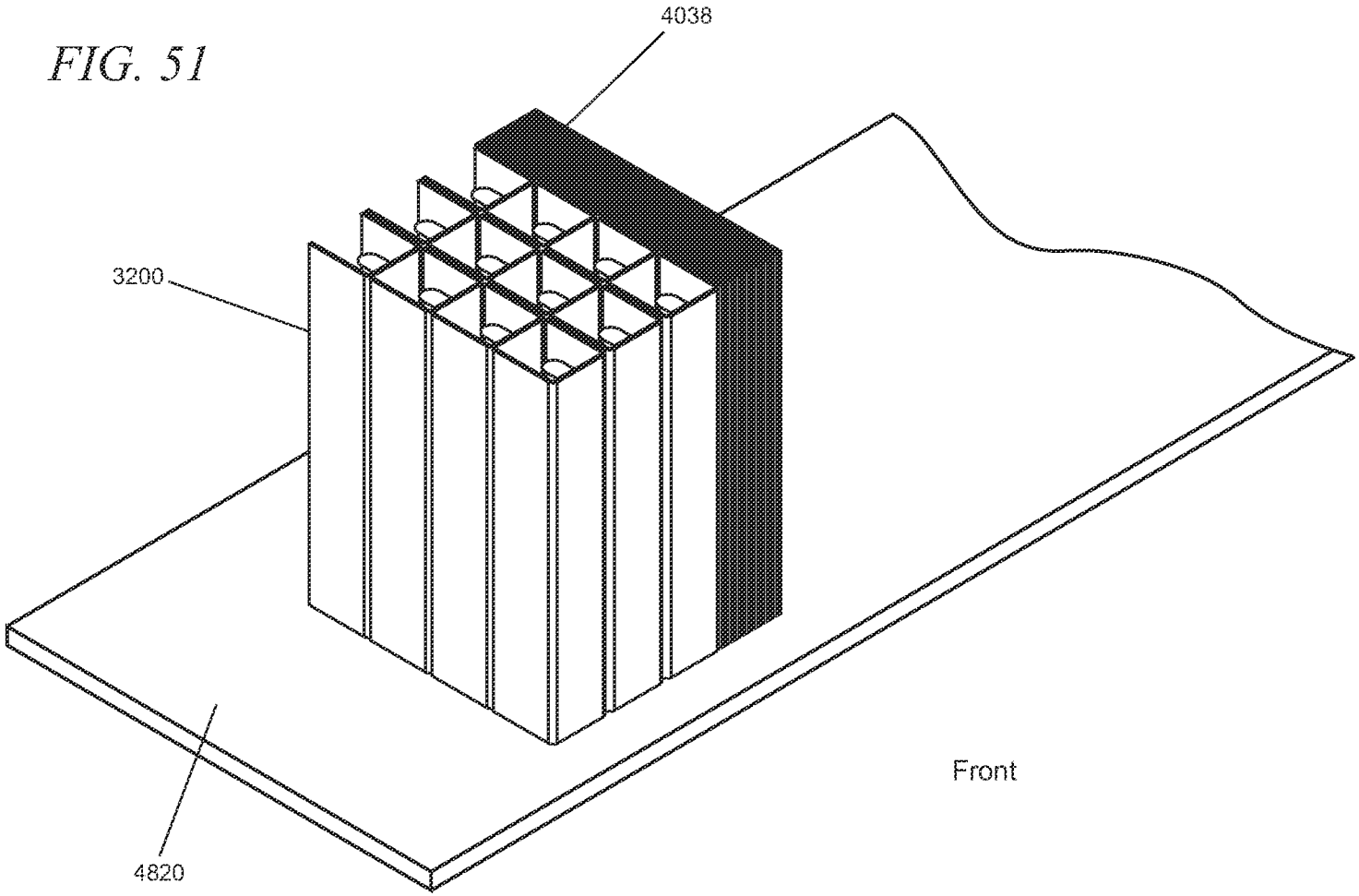
FIG. 51 illustrates typical storage and display practices that are used when dealing with a plurality of the present ring binders having attachable and detachable covers.

FIG. 51 illustrates a typical storage and display practice that may be applied to the present ring binder with attachable and detachable covers. In this particular example, a plurality of unassembled circular ring binders (i.e., spines combined with their respective front and back extensions) such as binder 3200 shown beginning at FIG. 32 and described in the accompanying text, are arranged on a shelf 4820 (in the drawings that follow, the attachment features including the snap-fit fasteners and retaining flanges are omitted for clarity). The 12 ring binders 3200 are arranged in an array of three columns of four rows, although other array dimensions can also be utilized. The 24 covers that are needed for the 12 ring binders 3200 are shown as being vertically positioned on edge in a horizontal stack next to the binders. A representative cover is indicated by reference numeral 4038. As noted above, the covers 4038 are configured identically and each can be used for either a front or back cover on any of the ring binders 3200.

Figure 52:
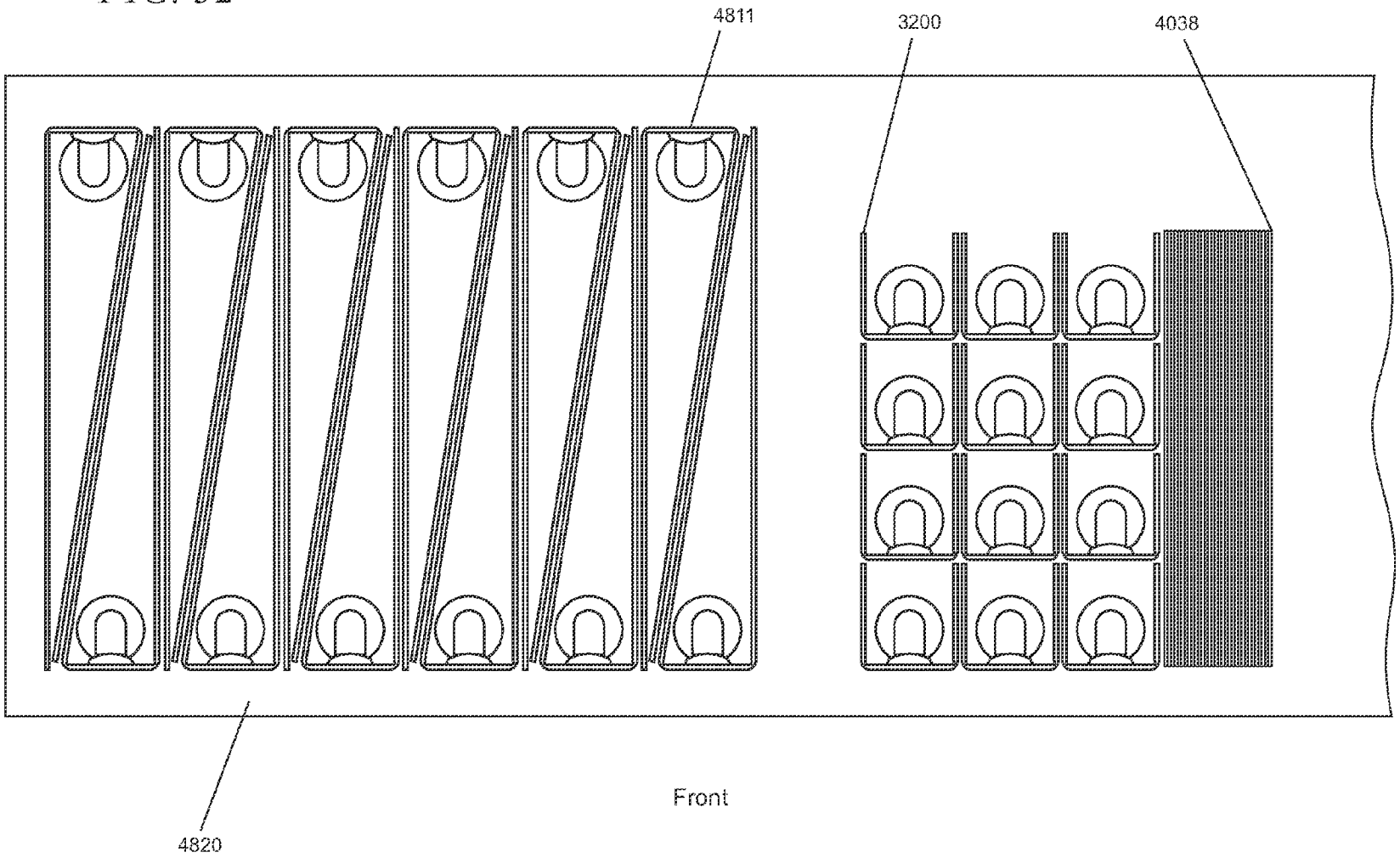
FIGS. 52 and 53 depict a comparison between display and storage practices of conventional ring binders and the present ring binders having attachable and detachable covers.

FIG. 52 shows a top view of 12 conventional ring binders 4811 arranged in an alternating spine orientation on a shelf 4820. Positioned next to the conventional ring binders are 12 of the present ring binders with attachable/detachable covers 3200 and 24 covers 4038. It can be determined by observation that the ring binders 3200 and covers 4038 require less display storage space than do the conventional binders 4811. Performing a calculation of the 12 binder footprint of the respective types shown in FIG. 52 indicates that the present ring binder with attachable/detachable covers occupies an area on the shelf 4820 that is approximately 46% of the area occupied by the conventional ring binders. While the savings in area can vary depending on the number of ring binders being stored and binder sizes, for most typical applications the present ring binders occupy half or less of the display/storage space needed by conventional ring binders.

Figure 53:
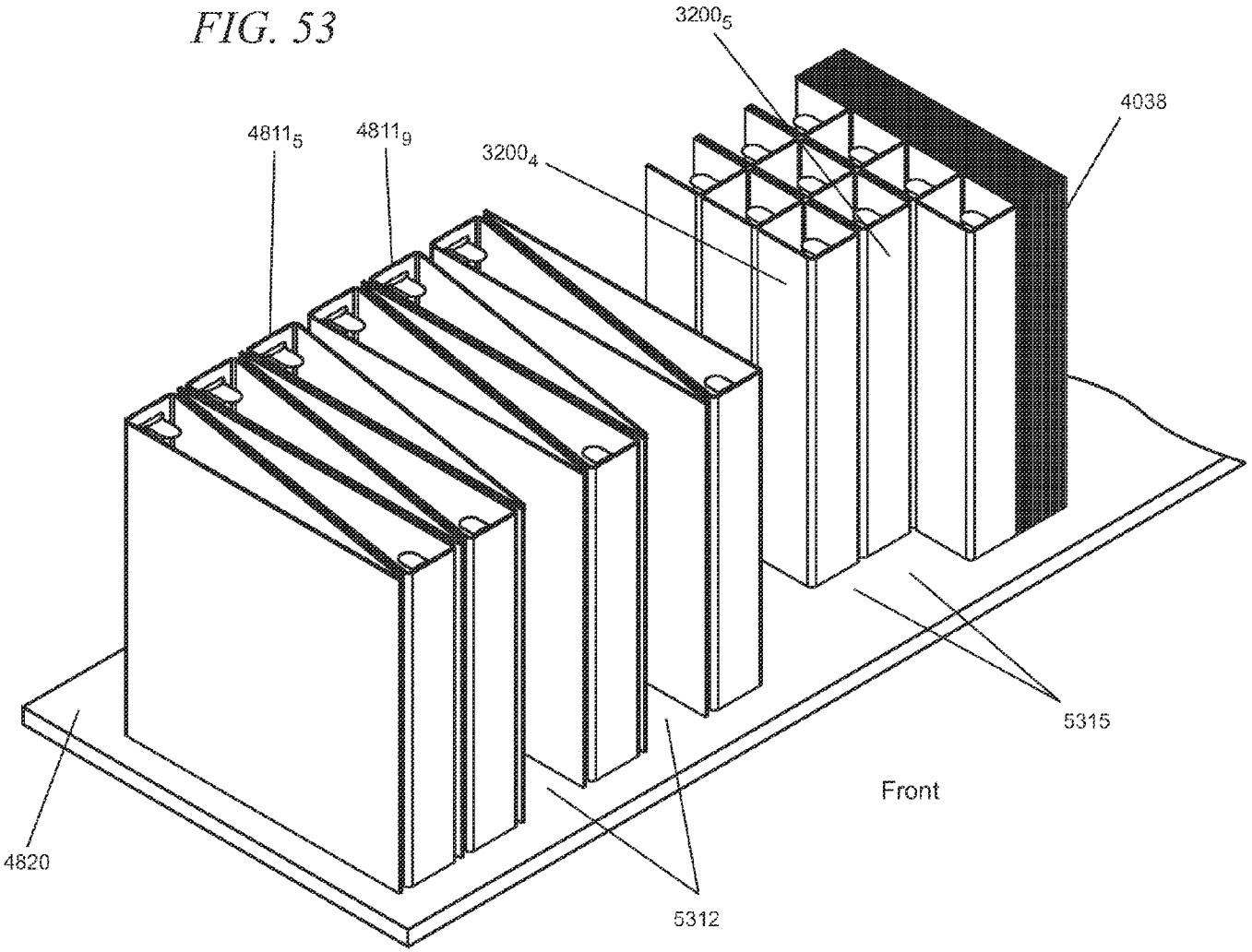

FIG. 53 shows an illustrative comparative usage scenario where binders are removed from displayed inventory over time. In this example, two conventional ring binders have been removed for purchase from a displayed stock of 12 binders 4811. Two empty spaces in the displayed stock are indicated by reference numeral 5312. The conventional ring binders $\mathbf{4811}_5$ and $\mathbf{4811}_9$ which are exposed after the purchased binders are removed can be difficult for customers to see because of the alternating spine arrangement utilized for display. That is, customers generally expect to interact with binders having their spines facing front as that is the usual manner in which binders and other printed materials such as books are stored and retrieved during normal use, for example using a bookcase. The reverse orientation of the half of the displayed stock of conventional ring binders may thus make it more difficult for customers to find a desired binder (e.g., one having a particular size, color, etc.). In order to address such difficulty, it may be common for retail store personnel to have to constantly handle the conventional ring binder inventory and readjust its presentation on the shelf which can be time-consuming and add costs to the retailer's operation.

FIG. 53 also shows a displayed stock of the present ring binders having attachable/detachable covers. Two binders have been removed from a displayed stock of 12 ring binders 3200 and empty spaces are indicated by reference numeral 5315. Unlike the conventional ring binders, the ring binders 3200 are all displayed with their spines facing forward. Therefore the ring binders $\mathbf{3200}_4$ and $\mathbf{3200}_5$ which are exposed after the purchased binders are removed are readily seen since the binders' outside spines are oriented to meet customers' expectations.

Figure 54:
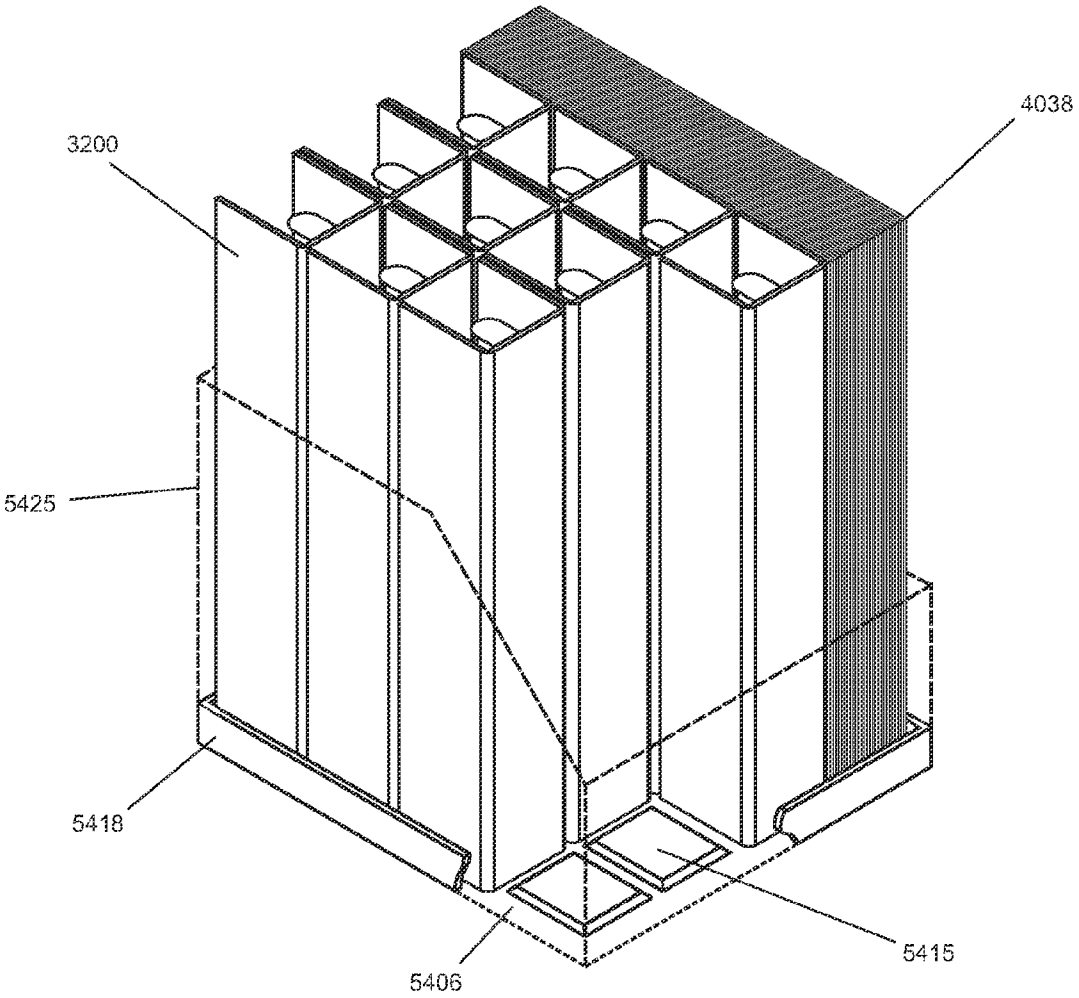
FIG. 54 shows a tray that may be utilized for display/storage and shipping of the present ring binders having attachable and detachable covers.

FIG. 54 shows a tray 5406 that may be utilized for display/storage and shipping purposes. Tray 5406 may be configured as a disposable article using, for example, cardboard (such as corrugated cardboard) or a vacuum-formed polymer such as ABS (acrylonitrile butadiene styrene). Tray 5406 includes projecting features, representatively indicated by reference numeral 5415, that are arranged to locate and hold unassembled binders and covers within the tray sidewalls 5418 (shown in partial phantom view) that extend around the perimeter of the tray. The features 5415 may be dimensioned to map to a particular ring binder size so that the spine/extension portion of the stored binders are securely held within the tray 5406 while still being easy for customers to remove from the tray at the point of purchase. The trays may also be utilized in pairs at both the top and bottom of the binders/covers to assist in organizing and securing the products in boxes for shipping.

In an alternative configuration, the tray may include extended sides and front portions, as indicated by the dashed line 5425 in FIG. 54. In such configuration, the tray may be integrated as part of a shipping and/or display box where a portion of the box is removed, for example along pre-formed perforations, to reveal the contents including the unassembled binders and covers. The particular configuration and size of the extended portions can vary by implementation.

While tray 5406 is shown in FIG. 54 as being configured to hold 12 binders and 24 covers it is emphasized that other configurations for other numbers of binders/covers may also be used to meet the needs of a particular implementation. In addition, in some scenarios the unassembled binders and covers can be sold separately. For example, a customer may wish to buy a single unassembled binder (i.e., a spine and front and back extensions) and six covers having different features (e.g., plain, view feature, and/or pockets) and colors. In this scenario, the display/storage packaging may be adapted so that the unassembled binders and covers are separately packaged and displayed.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A ring binder subassembly configured for use with attachable and detachable front and back covers, the ring binder subassembly, when attached to the front and back covers, forming a ring binder assembly, the ring binder subassembly comprising:

a spine having a front edge and a back edge;

one or more binder rings configured in a ring assembly, the ring assembly being located adjacent to the spine so that the bound edges of papers stored in the ring assembly are arranged proximal to the spine;

a front extension hingedly fixed to the spine's front edge at one or more points along the front extension's proximal edge, the front extension having a width that is substantially coextensive with a maximum projection of the one or more binder rings along an axis that is perpendicular to an inside surface of the spine, the front extension being mateably attachable at the front extension's distal edge to the front cover, the front cover and front extension when attached being pivotable as a unit about a hinge axis disposed substantially between the spine's front edge and the front extension's proximal edge so that the front cover may be opened and closed when the assembled ring binder is used;

a back extension hingedly fixed to the spine's back edge at one or more points along the back extension's proximal edge, the back extension having a width that is substantially coextensive with a maximum projection of the one or more binder rings along an axis that is perpendicular to an inside surface of the spine, the back extension being mateably attachable at the back extension's distal edge to the back cover, the back cover and back extension when attached being pivotable as a unit about a hinge axis disposed substantially between the spine's back edge and the back extension's proximal edge so that the back cover may be opened and closed when the assembled ring binder is used;

a front attachment arrangement for attaching the front cover to the front extension comprising one or more snap-fit fasteners disposed at the front extension's distal edge which are configured to mateably engage with respective one or more engagement features on the front cover's leading edge, the engagement features comprise a through hole that is configured to interface with a mating button projecting from the inside face of the snap-fit fastener;

a back attachment arrangement for attaching the back cover to the back extension comprising one or more snap-fit fasteners disposed at the back extension's distal edge which are configured to mateably engage with respective one or more engagement features on the back cover's leading edge, the engagement features comprise a through hole that is configured to interface with a mating button projecting from the inside face of the snap-fit fastener;

a front retaining flange disposed at the distal edge of the front extension, the front retaining flange being at least partially located opposite the one or more snap-fit fasteners on the distal edge of the front extension so as to form a front cover receiving channel between an inside face of the one or more snap-fit fasteners and outside face of the front retaining flange, the front cover receiving channel having a width that is sized to capture a thickness of the front cover in a substantially close fitting manner; and a rear retaining flange disposed at the distal edge of the rear extension, the rear retaining flange being at least partially located opposite the one or more snap-fit fasteners on the distal edge of the rear extension so as to form a rear cover receiving channel between an inside face of the one or more snap-fit fasteners and outside face of the rear retaining flange, the rear cover receiving channel having a width that is sized to capture a thickness of the rear cover in a substantially close fitting manner.

2. The ring binder subassembly of claim 1 in which the one or more binder rings are hingedly attached to a ring assembly with a hinge, the one or more binder rings being openable and closeable through motion about the hinge.

3. The ring binder subassembly of claim 2 in which the ring assembly includes a mechanism for opening and closing the one or more binder rings.

4. The ring binder subassembly of claim 2 in which the ring assembly is attached to the spine.

5. The ring binder subassembly of claim 2 in which the ring assembly is attached to the back extension.

6. The ring binder subassembly of claim 2 in which the one or more binder rings are circular rings or D rings.

7. The ring binder subassembly of claim 1 in which the front and back attachment arrangements enable the front cover to form a butt joint with the front extension and the back cover to form a butt joint with the back extension.

8. The ring binder subassembly of claim 1 further comprising a front cover or a back cover that includes mating through holes to interface with the one or more snap-fit fasteners.

9. The ring binder subassembly of claim 1 further comprising a clear or translucent overlay on one side of the cover, the overlay being attached to the cover along its short edges and one of its long edges, the overlay forming a pocket that is accessible via an opening formed with the cover along the unattached long edge.

10. The ring binder subassembly of claim 9 further comprising one or more pockets located on the side of the cover opposite the overlay, the pockets having openings in different orientations so that at least one pocket is oriented with its opening in an up position regardless of the cover being oriented right side up or upside down.

11. The ring binder subassembly of claim 1 in which the extensions and spine are hinged with a living hinge.

12. The ring binder subassembly of claim 1 in which the spine and extensions are a unitary article formed from injection-molded polymer.

* * * * *